US010368638B2

(12) United States Patent
Hui et al.

(10) Patent No.: US 10,368,638 B2
(45) Date of Patent: Aug. 6, 2019

(54) MULTI-COMPONENT RECONFIGURABLE FURNISHING ASSEMBLY

(71) Applicant: Virco Mfg. Corporation, Torrance, CA (US)

(72) Inventors: Man F. Hui, Monterey Park, CA (US); Jonathan Kyle Yau, Torrance, CA (US); Scott Lloyd Fletcher, Redondo Beach, CA (US)

(73) Assignee: VIRCO MFG. CORPORATION, Torrance, CA (US)

( * ) Notice: Subject to any disclaimer, the term of this patent is extended or adjusted under 35 U.S.C. 154(b) by 0 days.

(21) Appl. No.: 15/595,772

(22) Filed: May 15, 2017

(65) Prior Publication Data

US 2017/0325587 A1 Nov. 16, 2017

Related U.S. Application Data

(60) Provisional application No. 62/337,211, filed on May 16, 2016.

(51) Int. Cl.
*A47B 87/02* (2006.01)
*A47B 7/02* (2006.01)
*A47B 83/02* (2006.01)

(52) U.S. Cl.
CPC ..... *A47B 83/02* (2013.01); *A47B 7/02* (2013.01)

(58) Field of Classification Search
CPC ... A47B 83/02; A47B 83/021; A47B 83/0213; A47B 83/0215; A47B 83/023; A47B 83/04; A47B 85/04; A47B 7/02; A47B 87/02; A47B 87/027; A47B 87/0215; A47B 87/0223; A47B 87/0246; A47B 87/0253; A47B 87/0261; A47B 87/0276; A47B 87/0284; A47C 16/02; A47C 16/025; A47C 16/04
(Continued)

(56) References Cited

U.S. PATENT DOCUMENTS 1,993,601 A * 3/1935 Goldberg ..... A47C 3/04 280/33.998
D153,909 S * 5/1949 Wais ..... 108/91
(Continued)

OTHER PUBLICATIONS

PlansNOW®, "Step Stool," *Woodsmith* Magazine, SKU 920195, August Home Publishing, pp. 1-5 (2003).

*Primary Examiner* — Kyle J. Walraed-Sullivan
(74) *Attorney, Agent, or Firm* — Knobbe, Martens, Olson & Bear, LLP

(57) ABSTRACT

Disclosed is a novel furnishing assembly. The assembly is comprised of multiple components, which are nestable or stackable in relation to one another. The components may be of different sizes and may mimic each other in structure. Each component is comprised of a top panel, two opposing legs, and one or more handles. A smaller component can be stacked on a larger component to form a stand up desk or lectern or the like. Each component can be used for various purposes, including as a stool, desk, or chair. Each leg includes two feet, which can be covered with glides. Each component can be secured to a substructure or include a crossmember for added stability. The components can include other components for improved functionality, including a magnet, a door, a drawer, a keyboard tray, or a storage box.

7 Claims, 33 Drawing Sheets

(58) Field of Classification Search
USPC ..... 297/239; 182/178.1, 178.2, 178.3, 178.4, 182/178.5
See application file for complete search history.

(56) References Cited

U.S. PATENT DOCUMENTS 2,709,119 A * 5/1955 Chapman ..... A47B 7/02 108/64
2,888,976 A * 6/1959 Hart ..... A47C 7/185 297/239
2,944,780 A * 7/1960 Monk ..... A47B 87/0223 108/186
3,053,397 A * 9/1962 Bliss ..... A47B 87/0223 206/511
3,100,459 A * 8/1963 Liss ..... A47B 7/02 108/53.3
3,102,733 A * 9/1963 Burnett ..... A47C 3/04 280/47.24
3,402,963 A * 9/1968 Fujioka ..... A47C 1/124 297/239
3,446,530 A * 5/1969 Rowland ..... A47C 3/04 297/239
3,672,723 A * 6/1972 Decursu ..... A47B 85/04 297/440.24
3,697,130 A * 10/1972 Barecki ..... A47C 1/124 297/239
3,862,689 A * 1/1975 Taub ..... A47B 87/0253 211/126.16
4,662,678 A * 5/1987 Halpert ..... A47C 3/04 297/239
4,736,998 A * 4/1988 Wilson ..... A47B 83/02 297/140
4,779,541 A * 10/1988 Milward ..... A47B 7/02 108/53.1
5,002,337 A * 3/1991 Engel ..... A47C 1/124 108/53.3
5,147,120 A * 9/1992 Ray ..... A47B 17/00 211/194
D351,077 S * 10/1994 Bressler ..... D6/687
5,613,448 A * 3/1997 Petty ..... A47B 7/02 108/91
5,762,396 A * 6/1998 Barile ..... A47C 3/04 297/239
D401,790 S * 12/1998 Buell ..... D6/687
5,860,697 A * 1/1999 Fewchuk ..... A47C 3/04 297/188.04
5,862,761 A * 1/1999 Moore ..... A47B 7/02 108/10
6,174,029 B1 * 1/2001 Swy ..... A47C 3/04 297/239
D447,891 S * 9/2001 Wood ..... D6/687
7,533,940 B1 * 5/2009 Zook ..... A47B 83/02 108/11
D686,438 S * 7/2013 Denby ..... D6/687
D755,546 S * 5/2016 Johnson ..... D6/675.3
D766,625 S * 9/2016 Johnson ..... D6/675.3
D767,291 S * 9/2016 Edwards ..... A47C 16/025 D6/353
D768,417 S * 10/2016 Johnson ..... D6/687
D777,481 S * 1/2017 Denby ..... D6/675.3
D802,227 S * 11/2017 Florey ..... D30/118
10,004,335 B2 * 6/2018 Ballendat ..... A47C 3/04
2002/0145097 A1 * 10/2002 Bruschi ..... A47C 3/04 248/346.01
2002/0153754 A1 * 10/2002 Huang ..... A47C 3/04 297/239
2002/0195907 A1 * 12/2002 Lawson ..... A47B 83/04 312/198
2004/0061365 A1 * 4/2004 Crue ..... A47C 3/04 297/239
2005/0264079 A1 * 12/2005 Selby ..... A01B 75/00 297/423.11
2006/0152114 A1 * 7/2006 Yamada ..... A47B 87/02 312/107
2007/0132291 A1 * 6/2007 Smith ..... A47C 3/04 297/239
2007/0214567 A1 * 9/2007 Wandel ..... A47B 83/04 5/3
2008/0093167 A1 * 4/2008 Saunders ..... A47C 12/00 182/33
2008/0105173 A1 * 5/2008 Weber ..... A47B 3/00 108/150
2008/0116727 A1 * 5/2008 Cox ..... A47C 3/04 297/239
2008/0257229 A1 * 10/2008 Gerig ..... A47B 83/00 108/53.3
2008/0315646 A1 * 12/2008 Hock ..... A47C 3/04 297/239
2009/0072599 A1 * 3/2009 Xu ..... A47C 3/04 297/239
2009/0273214 A1 * 11/2009 Shields ..... A47B 7/02 297/239
2010/0066139 A1 * 3/2010 Woodring ..... A47C 3/029 297/239
2010/0066140 A1 * 3/2010 Ware ..... A47C 3/04 297/239
2010/0156155 A1 * 6/2010 Smith ..... A47C 1/124 297/239
2010/0156156 A1 * 6/2010 Smith ..... A47C 1/124 297/239
2010/0194160 A1 * 8/2010 Machael ..... A47C 3/045 297/239
2012/0204769 A1 * 8/2012 Meiners ..... A47B 7/02 108/64
2013/0008865 A1 * 1/2013 Su ..... A47F 5/11 211/153
2013/0207421 A1 * 8/2013 Turner ..... A47D 1/04 297/135
2013/0284075 A1 * 10/2013 Reithler ..... A47B 17/03 108/91
2014/0145480 A1 * 5/2014 Johnson ..... A47C 3/04 297/239
2015/0196121 A1 * 7/2015 Chan ..... A45F 5/12 312/107
2015/0320207 A1 * 11/2015 Chan ..... A47B 87/0276 312/108
2015/0359390 A1 * 12/2015 Goetz ..... A47K 3/281 4/611
2016/0015177 A1 * 1/2016 Blake ..... A47B 87/002 108/64
2016/0095428 A1 * 4/2016 Turner ..... A47B 87/002 297/123
2017/0164744 A1 * 6/2017 Ballendat ..... A47C 3/04

* cited by examiner

MULTI-COMPONENT RECONFIGURABLE FURNISHING ASSEMBLY

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

The present invention generally relates to multi-component furnishings configured for multiple integrations.

Description of the Related Art

Furniture design involves a delicate balancing of form and function. Pieces should be aesthetically pleasing yet provide advantages over prior designs. Customers are demanding increased functionality even while seeking to minimize the space occupied by furnishings.

SUMMARY OF THE INVENTION

Accordingly, an aesthetically pleasing furniture design has been developed that provides a plurality of components that mimic each other in form yet cooperate together to provide the function of several different types of furnishings.

The systems, methods, and devices described herein have innovative aspects, no single one of which is indispensable or solely responsible for their desirable attributes. Without limiting the scope of the claims, some of the advantageous features will now be summarized.

In some configuration, a reconfigurable furniture system comprises a first component and a second component. The first component comprising a first top panel, a first leg, a second leg, and a first handle. The first leg and the second leg oppose each other. The first top panel is joined to the first leg and the second leg. Upper portions of the first leg and the second leg are inset relative to an outer periphery of the first top panel. Each of the first leg and the second leg has two arcuate sides. Each of the lower portions of the first leg and the second leg has a concave recess that defines a first foot and a second foot. The first handle being positioned on the first leg. The second component comprising a second top panel, a third leg, a fourth leg, and a second handle. The third leg and the fourth leg oppose each other. The second top panel is joined to the third leg and the fourth leg. Upper portions of the third leg and the fourth leg are inset relative to an outer periphery of the second top panel. Each of the third leg and the fourth leg has two arcuate sides. Each of the lower portions of the third leg and the fourth leg has a concave recess that defines a third foot and a fourth foot. The second handle being positioned on the third leg. The first component is configured to allow the second component to be suspended from the first component.

In some configurations, a reconfigurable furniture system comprises a first component and a second component. The first component comprises a first top panel, a first leg, a second leg, and a first handle. The first leg and the second leg oppose each other. The first top panel is connected to the first leg and the second leg. Upper portions of the first leg and the second leg are inset relative to an outer periphery of the first top panel. Each of the first leg and the second leg has two arcuate sides. Each of the lower portions of the first leg and the second leg has a concave recess that defines a first foot and a second foot. The first handle being positioned on the first leg. The second component comprising a second top panel, a third leg, a fourth leg, and a second handle. The third leg and the fourth leg oppose each other. The second top panel is coupled to the third leg and the fourth leg. Upper portions of the third leg and the fourth leg are inset relative to an outer periphery of the second top panel. Each of the third leg and the fourth leg has two arcuate sides. Each of the lower portions of the third leg and the fourth leg has a concave recess that defines a third foot and a fourth foot. The second handle being positioned on the third leg. The second component is sized to fit entirely within an area defined by a footprint of the first component when the second component is stored under the first component.

In some configurations, a reconfigurable furniture system comprises a first component and a second component. The first component comprises a first top panel, a first leg, a second leg, and a first handle. The first leg and the second leg oppose each other. The first top panel is coupled to the first leg and the second leg. Upper portions of the first leg and the second leg are inset relative to an outer periphery of the first top panel. Each of the first leg and the second leg has two arcuate sides. Each of the lower portions of the first leg and the second leg has a concave recess that defines a first foot and a second foot. The first handle being positioned on the first leg. The second component comprising a second top panel, a third leg, a fourth leg, and a second handle. The third leg and the fourth leg oppose each other. The second top panel is coupled to the third leg and the fourth leg. Upper portions of the third leg and the fourth leg are inset relative to an outer periphery of the second top panel. Each of the third leg and the fourth leg has two arcuate sides. Each of the lower portions of the third leg and the fourth leg has a concave recess that defines a third foot and a fourth foot. The second handle is positioned on the third leg. The second component is sized to fit entirely within an area defined by the first top panel when the second component is stacked on top of the first component.

In some configurations, a piece of furniture comprises a top. The top has two arcuate sides and two linear sides. The top also has an upper surface and a lower surface. a substructure is mounted to the lower surface. A first leg and a second leg are connected to opposing sides of the substructure. The first leg and the second leg extend downward from the top at an angle other than 90 degrees relative to the bottom surface of the top. Each of the legs expands in width in a downward direction from the top. The legs each incorporate a handle.

In some such configurations, the substructure is unitarily formed of a single piece of material. In some such configurations, the substructure comprises two separable components, with one of the two separable components connecting the first leg and the second leg and the other of the two separable components connecting the top to the first leg and the second leg. In some such configurations, two rails connect the top to the first leg and the second leg. In some such configurations, the first leg terminates in a pair of feet separated from each other by a first arcuate recess and the second leg terminates in a pair of feet separated from each other by a second arcuate recess. In some such configurations, a crossmember spans between and connects the first leg and the second leg. In some such configurations, the crossmember spans between two bottom portions of the first leg and the second leg.

In some configuration, a reconfigurable furniture assembly comprises a desk having a first top surface height, a chair having a second top surface height and a stool having a third top surface height. The first top surface height is greater than both the second top surface height and the second top surface height, and the second top surface height is greater than the third top surface height. When the stool is stacked upright on the top of the desk, the first and third top surface heights combine to establish a fourth top surface height of between 39 inches and 43 inches. When the stool is stacked on a side on top of the desk, the upper side surface defines an inclined top surface that has an upper height of between 48 inches and 44 inches and a lower height of between 44 inches and 40 inches.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF THE PREFERRED EMBODIMENTS

Figure 1:
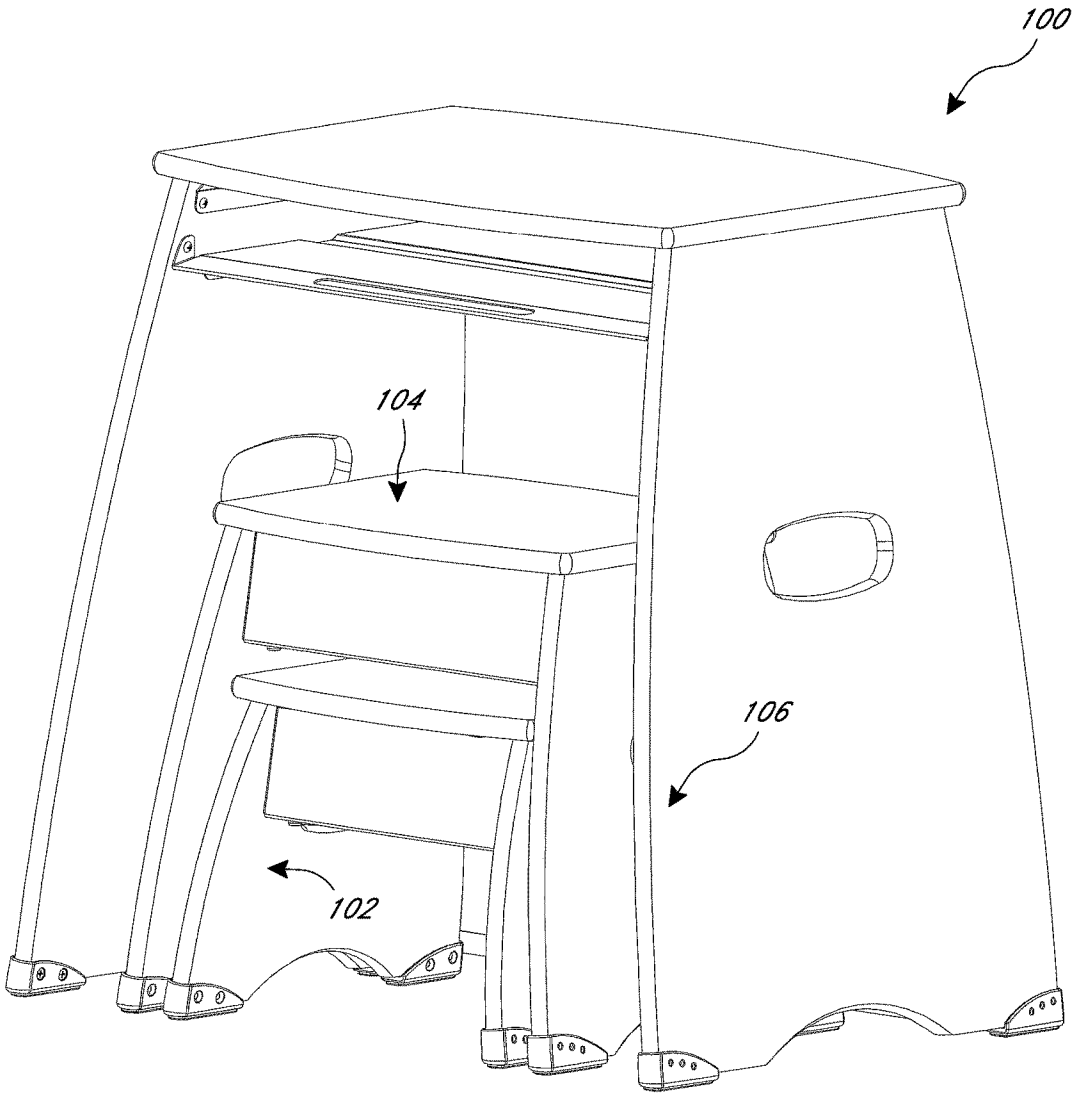
FIG. 1 is a perspective view of three nested components.
Figure 2:
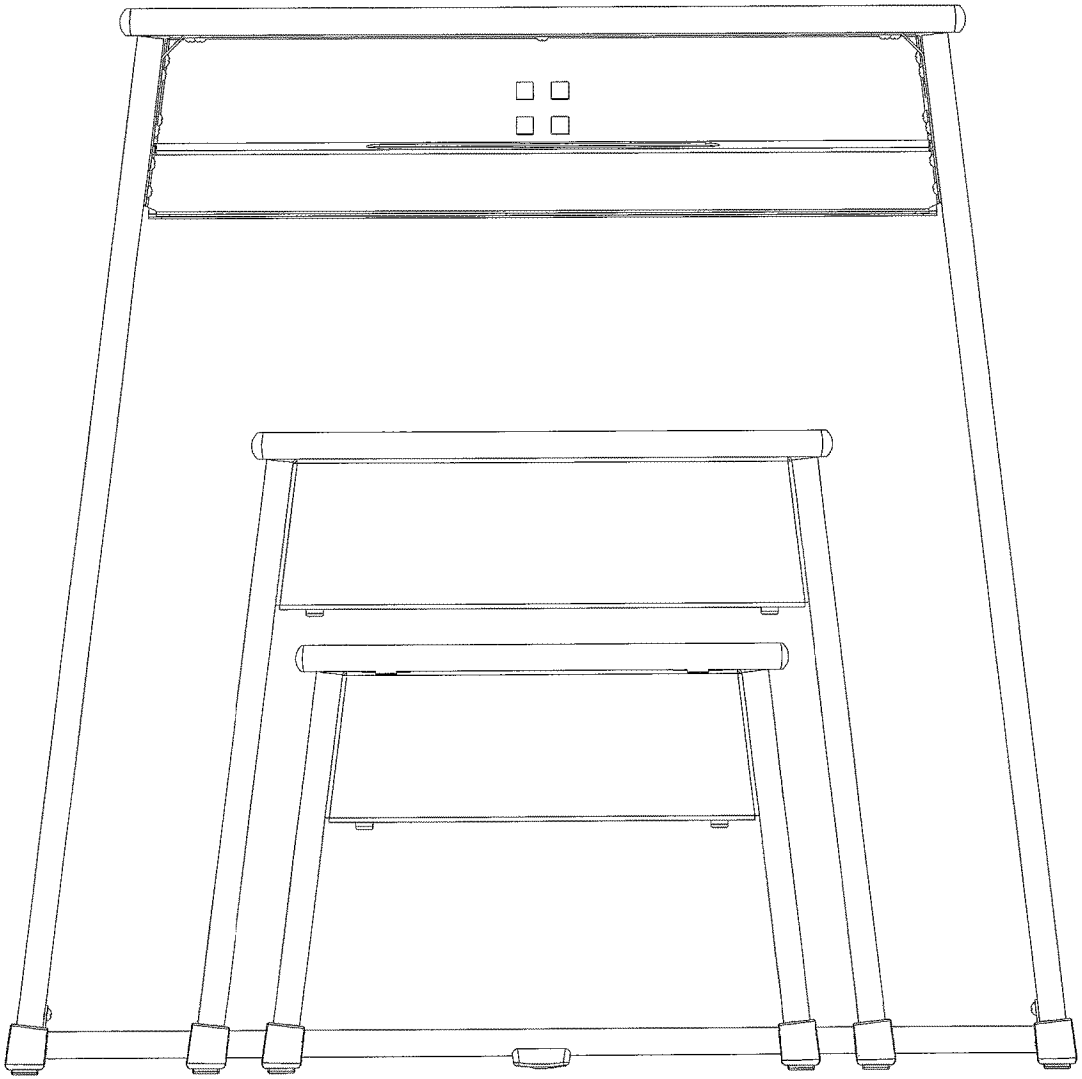
FIG. 2 is a front view of the three nested components of FIG. 1.

With reference initially to FIGS. 1-7, a grouping 100 of furnishing components is shown in a nested configuration. In the illustrated configuration, the grouping 100 comprises three distinct components. In some configurations, the grouping 100 consists of three distinct components. In some configurations, the grouping 100 consists of two distinct components. In the illustrated configuration, the grouping 100 comprises a small component 102, a medium component 104, and a large component 106. The small component 102 can be a footstool, lectern, or the like. The medium component 104 can be a chair or sitting stool or the like. The large component 106 can be a desk or other work surface or the like. In some configurations, the height of the small component 102 is 12 inches. The height can be between 10 inches and 14 inches. In some configurations, the height of the medium component 104 is 18 inches. The height can be between 17 inches and 19 inches. In some configurations, the height of the large component 106 is 30 inches. The height can be between 25 inches and 35 inches.

Figure 3:
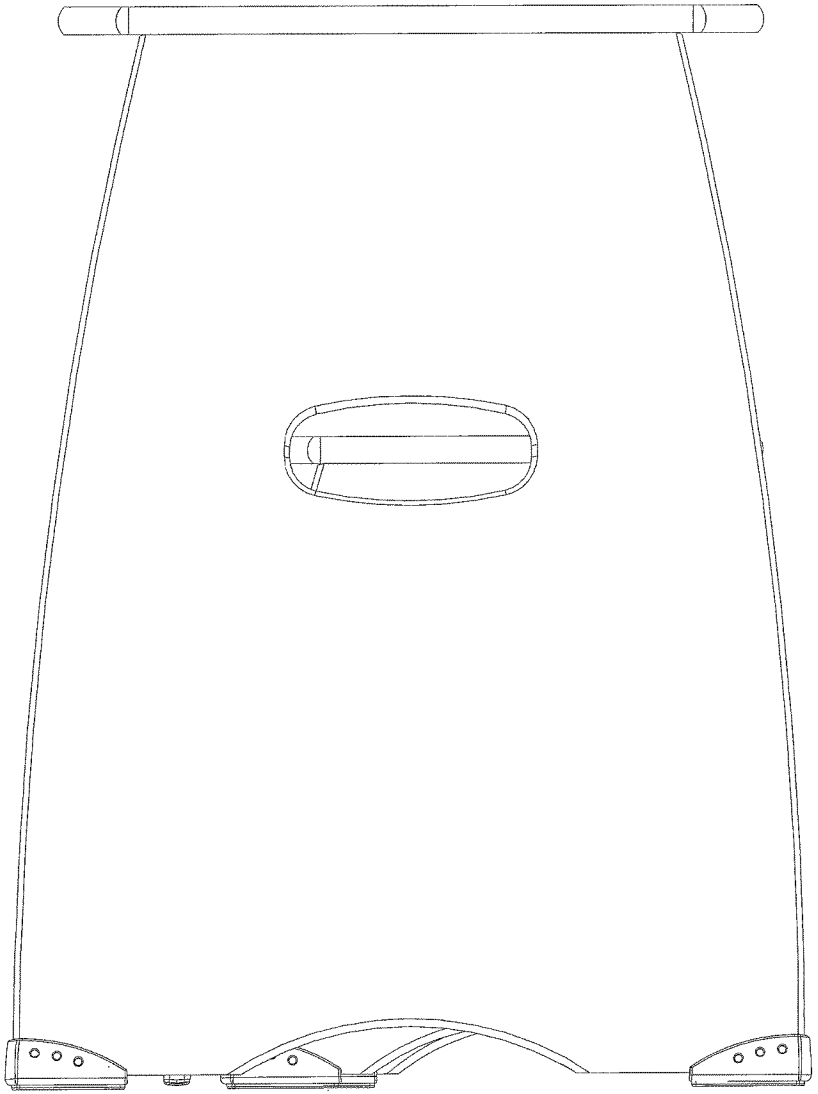
FIG. 3 is a left side view of the three nested components of FIG. 1.
Figure 4:
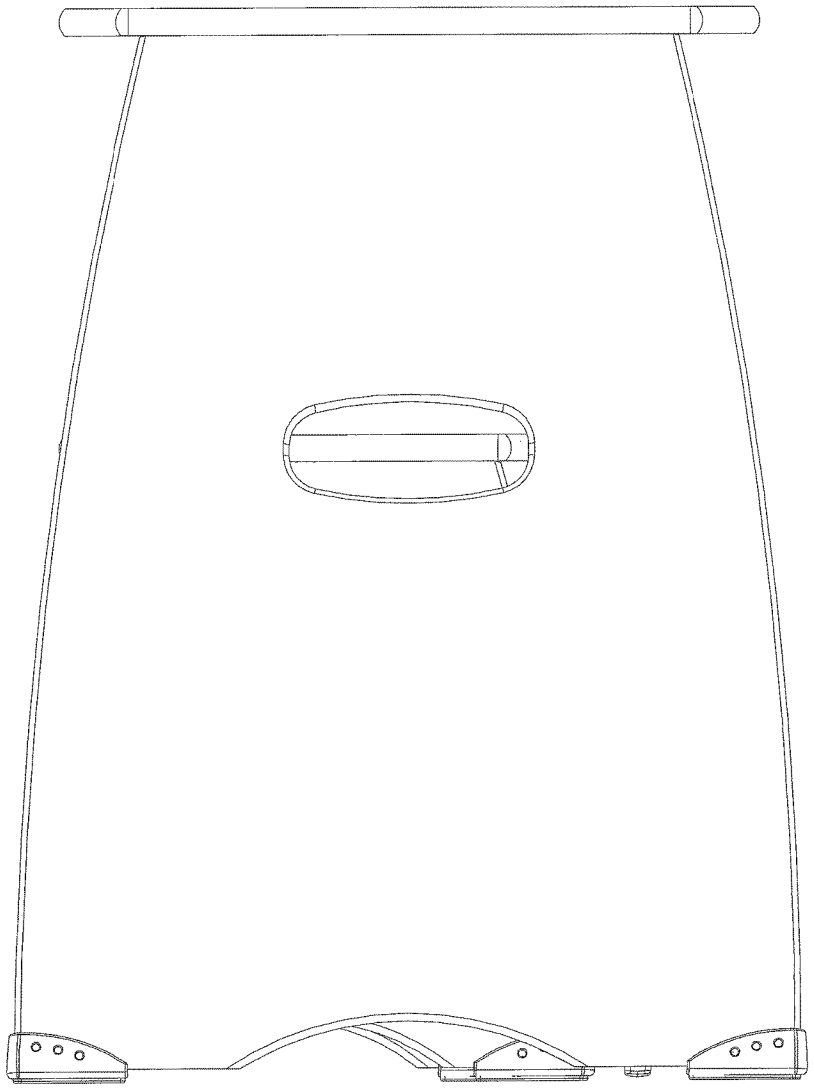
FIG. 4 is a right side view of the three nested components of FIG. 1.
Figure 5:
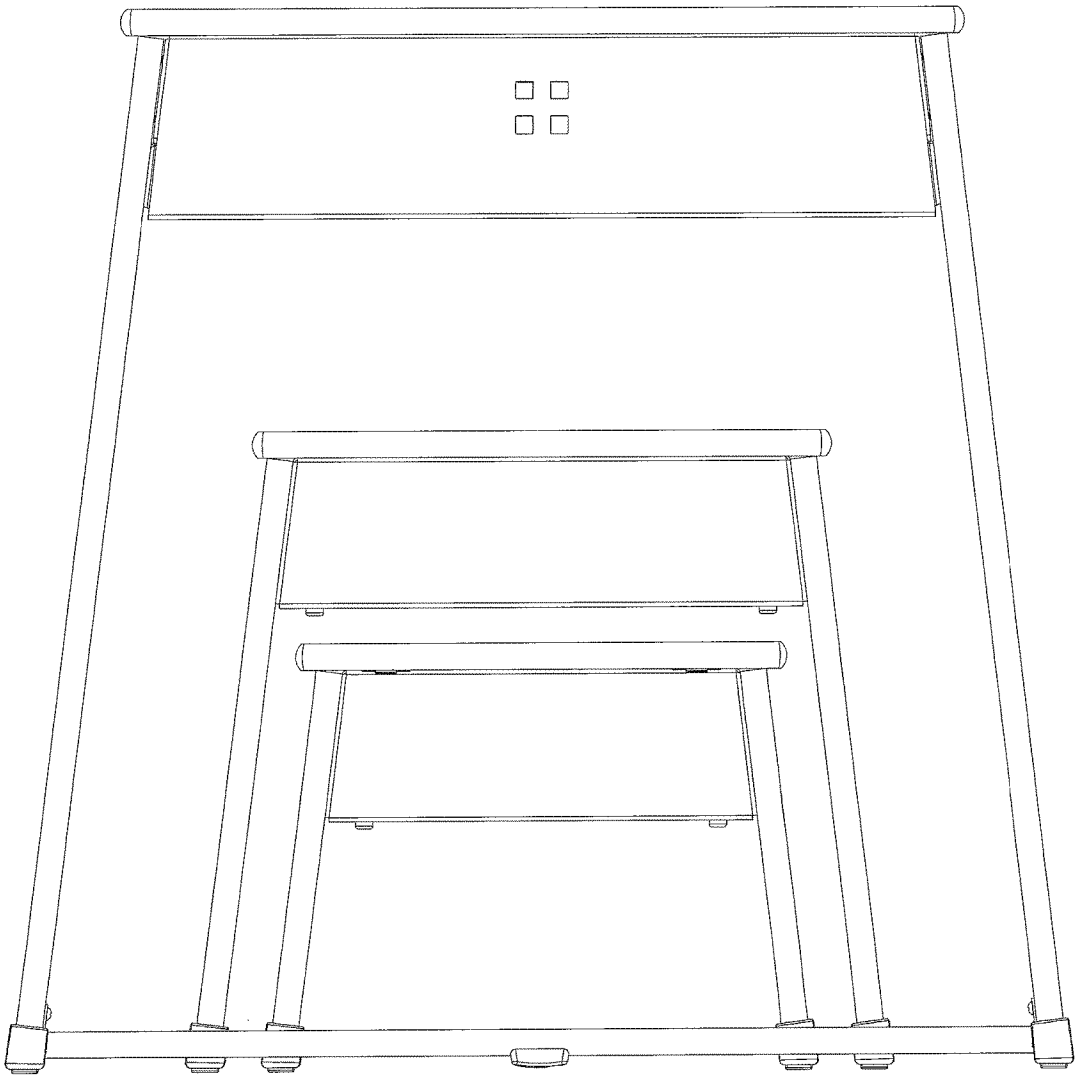
FIG. 5 is a rear view of the three nested components of FIG. 1.
Figure 6:
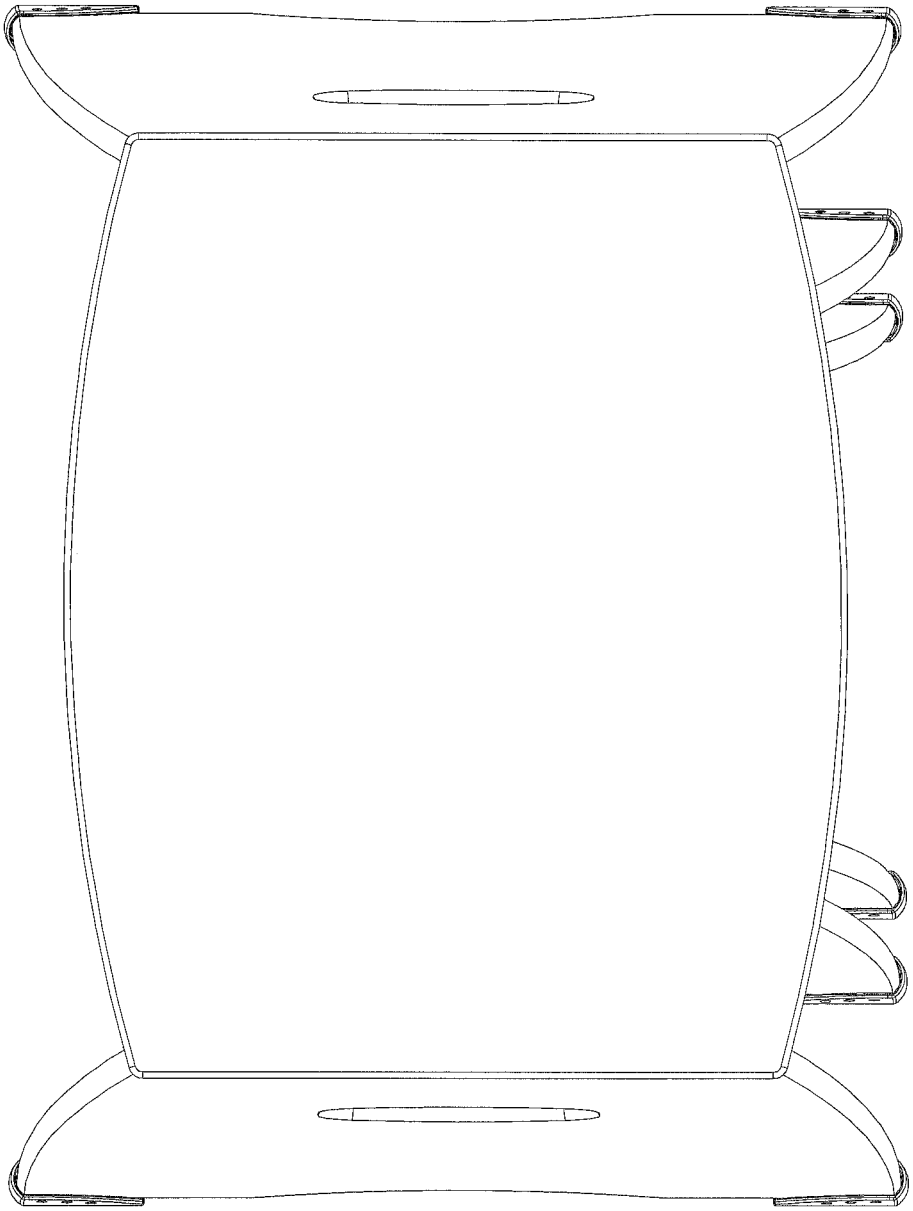
FIG. 6 is a top view of the three nested components of FIG. 1.
Figure 7:
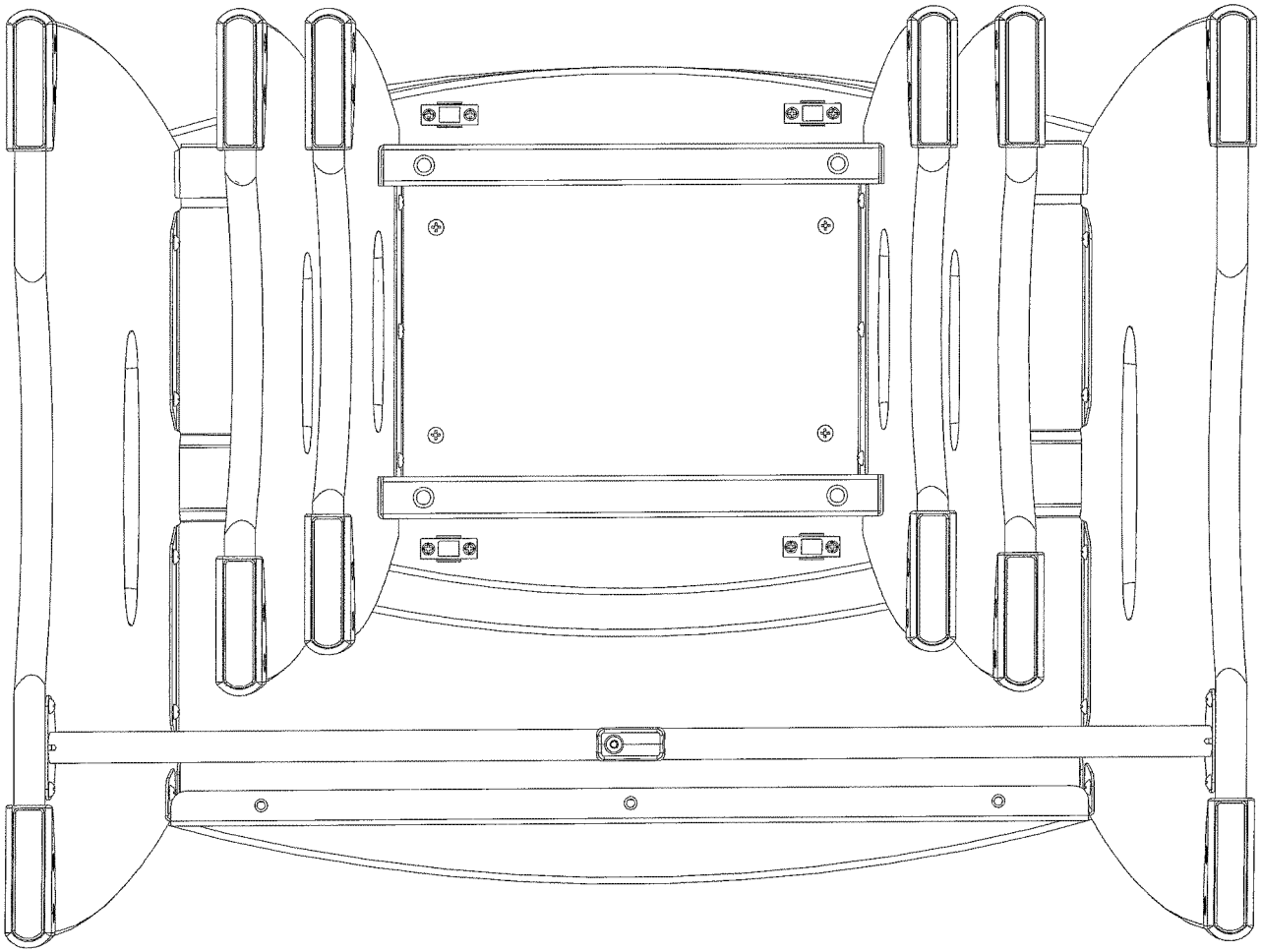
FIG. 7 is a bottom view of the three nested components of FIG. 1.
Figure 8:
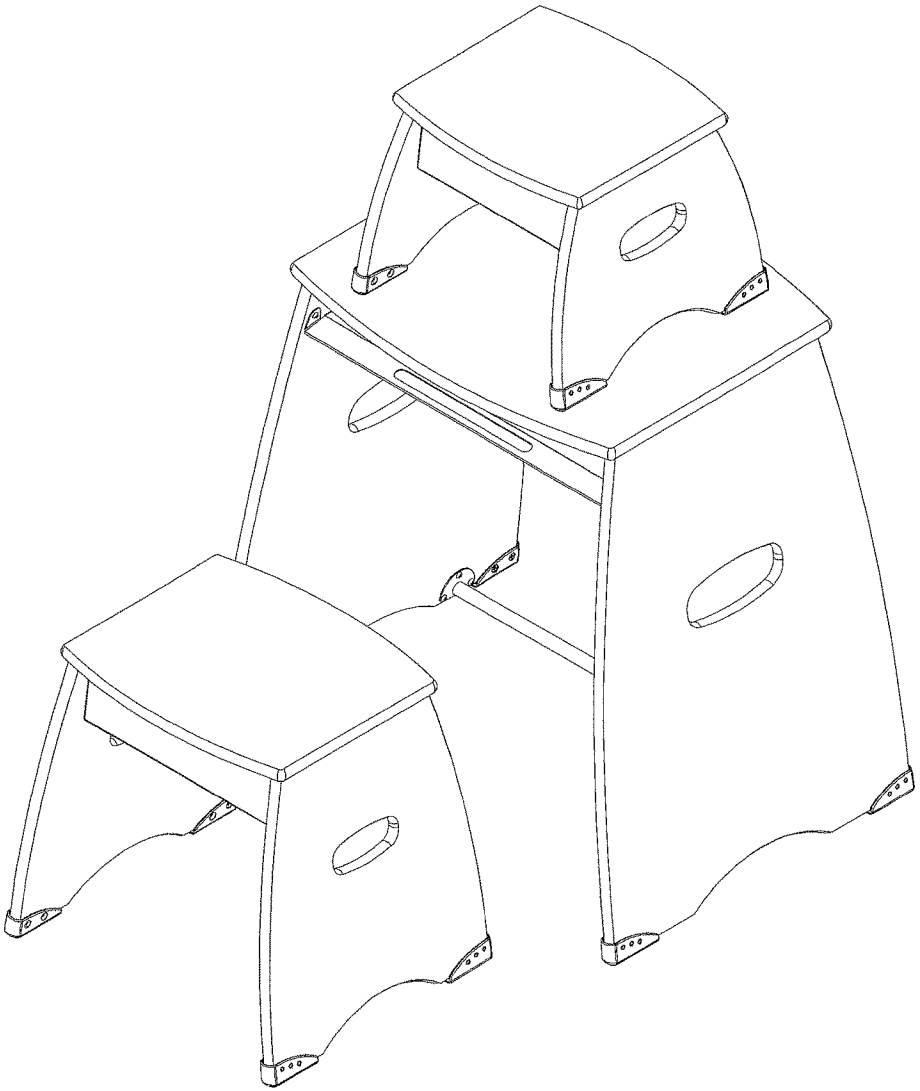
FIG. 8 is a perspective view of three components with the smallest component stacked on top of the largest component in a standing desk formation.
Figure 9:
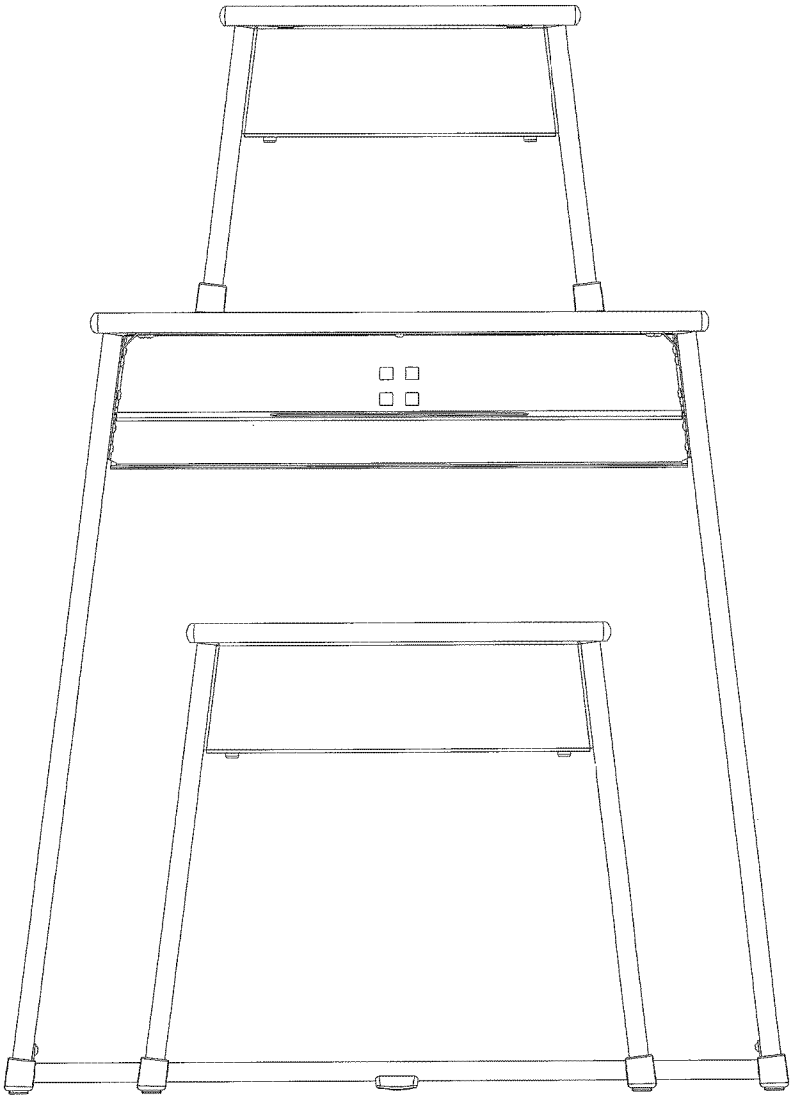
FIG. 9 is a front view of the three components of FIG. 8.
Figure 10:
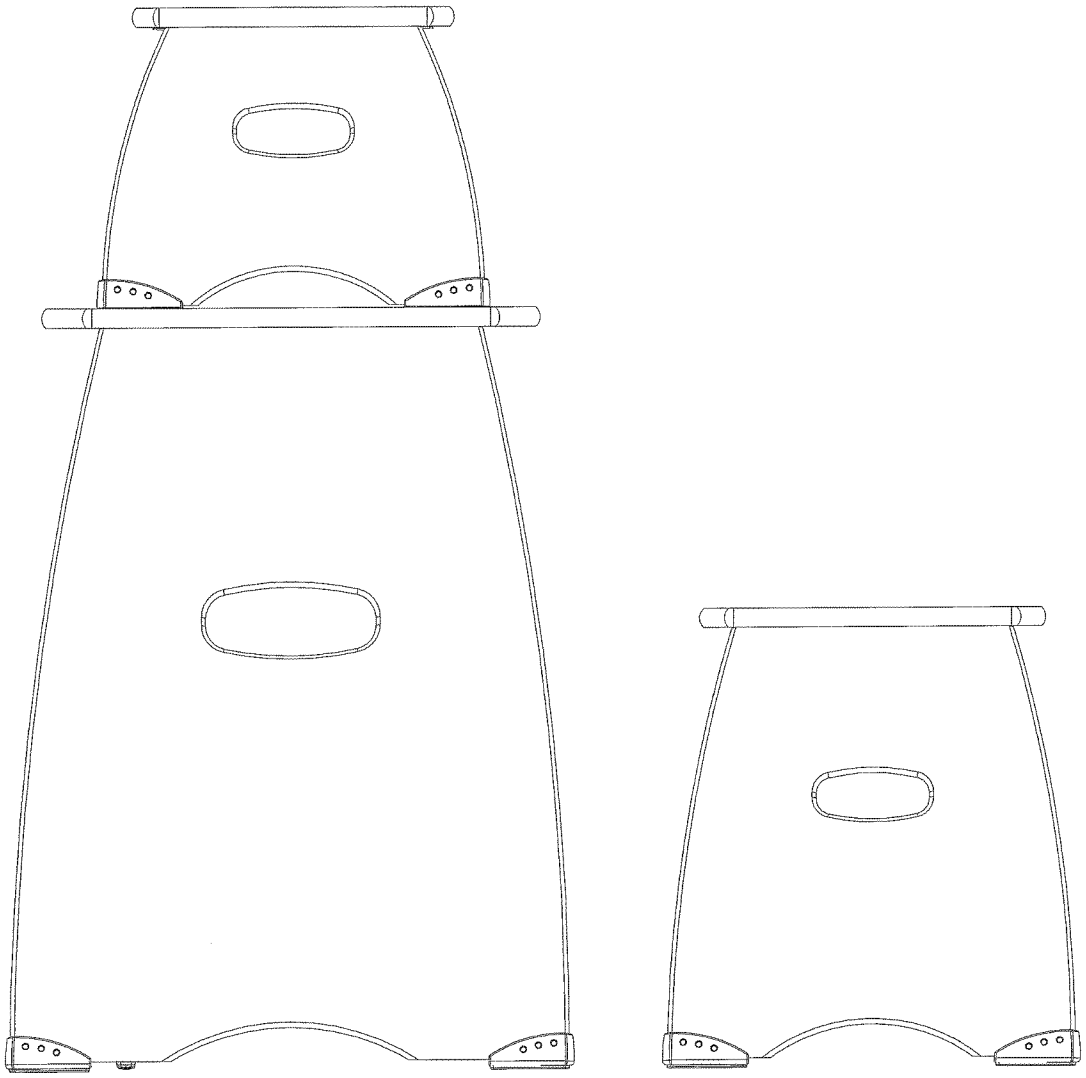
FIG. 10 is a left side view of the three components of FIG. 8.
Figure 11:
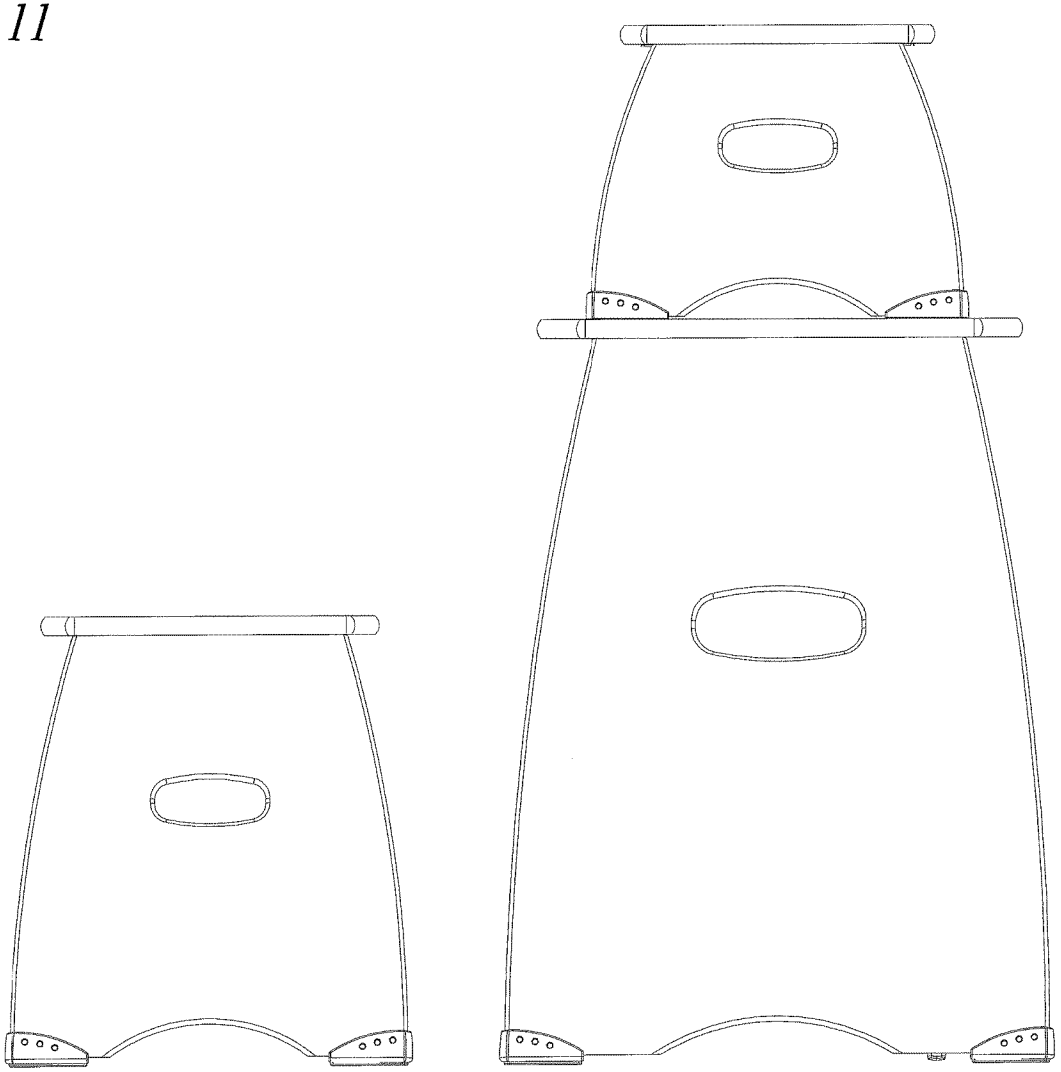
FIG. 11 is a right side view of the three components of FIG. 8.
Figure 12:
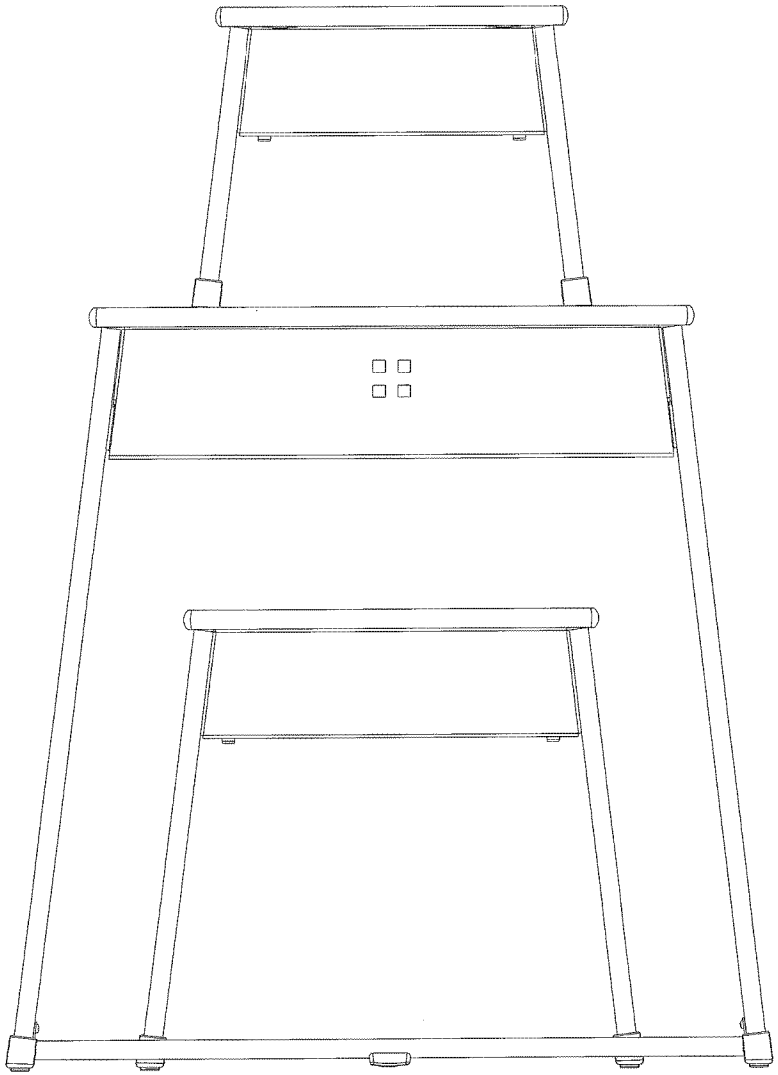
FIG. 12 is a rear view of the three components of FIG. 8.
Figure 13:
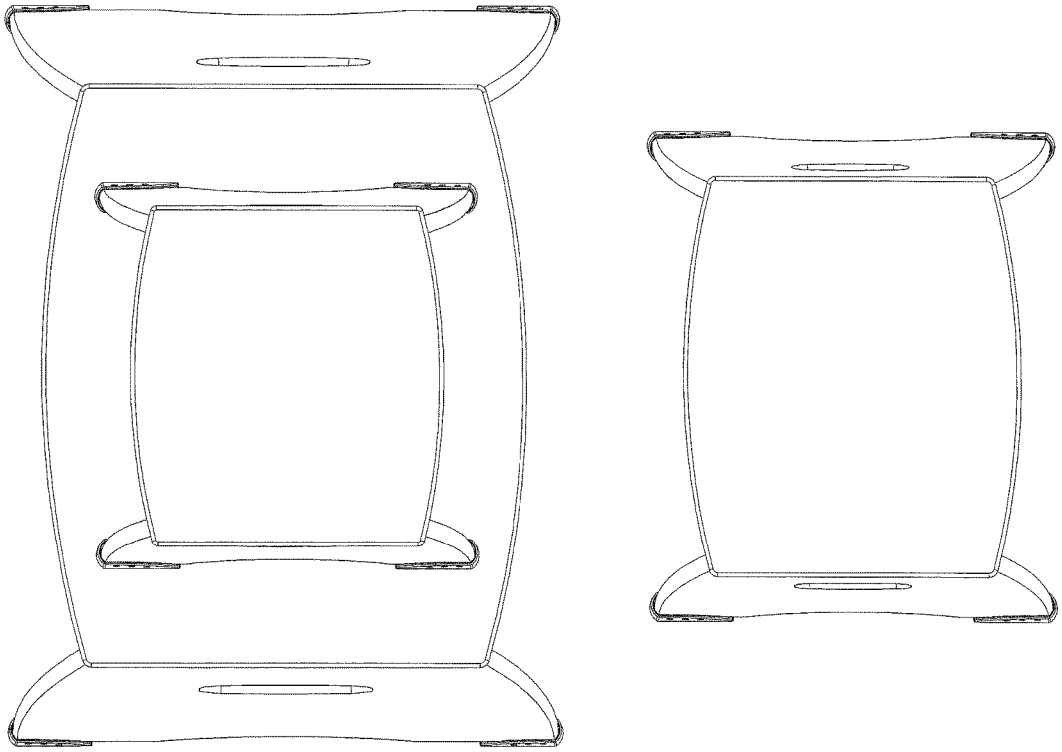
FIG. 13 is a top view of the three components of FIG. 8.
Figure 14:
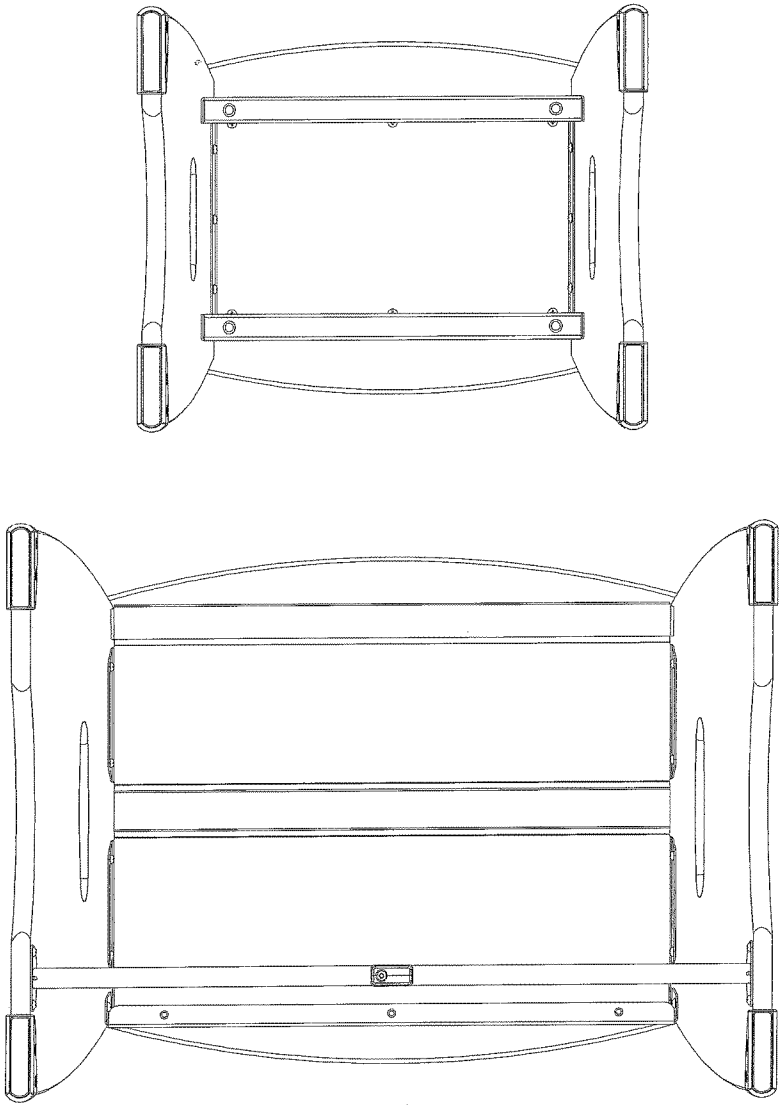
FIG. 14 is a bottom view of the three components of FIG. 8.

With reference to FIGS. 3 and 4, the components 102, 104, 106 are shown from the side. As illustrated, in some configurations, the components 102, 104, 106 are sized and configured such that the small and medium components 102, 104 can be fully positioned within a footprint defined by the large component 106. In other words, when nested in the manner shown, the two smaller components 102, 104 fit entirely within the space defined by the base of the larger component 106. In the illustrated configuration, the smallest component 102 also fits entirely within the footprint defined by the medium component 104. Furthermore, in the illustrated configuration, the smallest component 102 fits below the medium component 104 without touching the medium component 104 and the medium component 104 fits below the large component 106 without touching the large component 106. In some configurations, the medium component 104 fits under the large component 106 but contacts a crossmember (described later) of the large component 106. In some configurations, including the illustrated configuration, when nested and viewed from the side, the only component viewable along the upwardly extending edges of the side surfaces is the large component.

In some configurations, the small component 102 can be docked to the medium component and/or the medium component 104 can be docked to the large component 106. In such configurations, rails or other suitable structures can be used that allow or facilitate the medium component 104 being supported above the ground by the large component 106 and/or the small component 102 being supported above the ground by the medium component 104. For example, brackets can be mounted to a bottom surface of the large component 106 and a lip defined on the medium component 104 can be supported by the brackets of the large component 106. In some configurations, the brackets can have an L-shape to support the lip. In some configurations, supports can extend inwardly from legs of the supporting component and support the lip of the supported component. The supports can be one or more component. For example, the supports can be two or more posts that extend inwardly from the legs. In such configurations, the posts can be used to support straps for bags, purses or the like. The supports also can be configured to fold out of the way when not in use. Similar configurations can be used to connect the small component 102 and the medium component 104. Any other suitable docking arrangement can be used keeping in mind a desire to suspend the small component 102 and the medium component 104 from the large component 106.

With reference to FIGS. 8-14 and FIGS. 22-28, the components 102, 104, 106, in addition to being nestable, also are stackable in different configurations to provide different types of working environments. For example, as shown in FIGS. 8-14, the smaller component 102 can be stacked on top of the larger component 106 with the smaller component 102 being positioned in an upright position. When stacked on top of the larger component 106, the entirety of the smaller component 102 fits on the top surface of the larger component 106. In some configurations, the smaller component 102 fits on the top surface of the larger component 106 without any portion overhanging from the top surface of the larger component 106.

With the smaller component 102 stacked on top of the larger component 106 in an upright position, a top surface or working surface of the smaller component 102 can define a stand up desk surface or stand up laptop station. In some configurations, the height of the top surface or working surface of the smaller component 102 in this configuration is 42 inches. The height can be between 35 inches and 49 inches. Other configurations also are possible.

With specific reference to FIGS. 22-28, the smaller component 102 also can be stacked on top of the larger component 106 with a leg of the smaller component 102 facing downward (i.e., the smaller component 102 is on a side). Because of the structure of the smaller component 102, positioning the smaller component 102 on a side and on top of the larger component 106 results in a working surface defined by a side or leg of the smaller component 102. The working surface is inclined and has an uppermost height of 46 inches and a lowermost height of 42 inches. In some configurations, the uppermost height ranges between 48 inches and 38 inches while the lowermost height ranges between 46 inches and 30 inches. In such a configuration, the working surface extends to a lip defined by an intersection of the leg or side of the smaller component 102 and the top of the smaller component 102. The configuration, therefore, results in a lectern configuration. In some configurations, the smaller component 102 can be provided with a cover (not shown). The cover can be generally rectangular and the face of the cover can be parallel to the top 110. In some configurations, the cover can enclose or conceal the feet 124 of the smaller component 102. In some configurations, the cover can enclose or conceal another portion of the smaller component 102. In some configurations, the cover can include logos or other designs as desired by the customer.

In some configurations where multiple components of the same size are present, the multiple components of the same size can be stacked for storage. For example, by turning each component 90 degrees, an alternating direction stack of components can be created because the distance between the legs is greater than the front to back distance of the top of the component. In this manner, especially in institutional environments, the components can be stacked and stored in a very space efficient manner.

In addition to being stackable, the illustrated components 102, 104, 106 can be used in various manners. For example, the smaller component 102 can be a foot stool when a user sits upon the medium component 104 or the larger component 106. The smaller component 102 can be a foot stool used to help reach things on higher shelves or the like as well. The medium component 104 can be used as a chair while the larger component 106 serves as a desk or other working surface. In some configurations, the smaller component can be used as a chair while the medium component 104 is used as a desk or other working surface. In some configurations, the smaller component 102 can be used as a desk or other working surface when the user is sitting on the floor. Other iterations also are possible depending upon the desires of the user.

Figure 15:
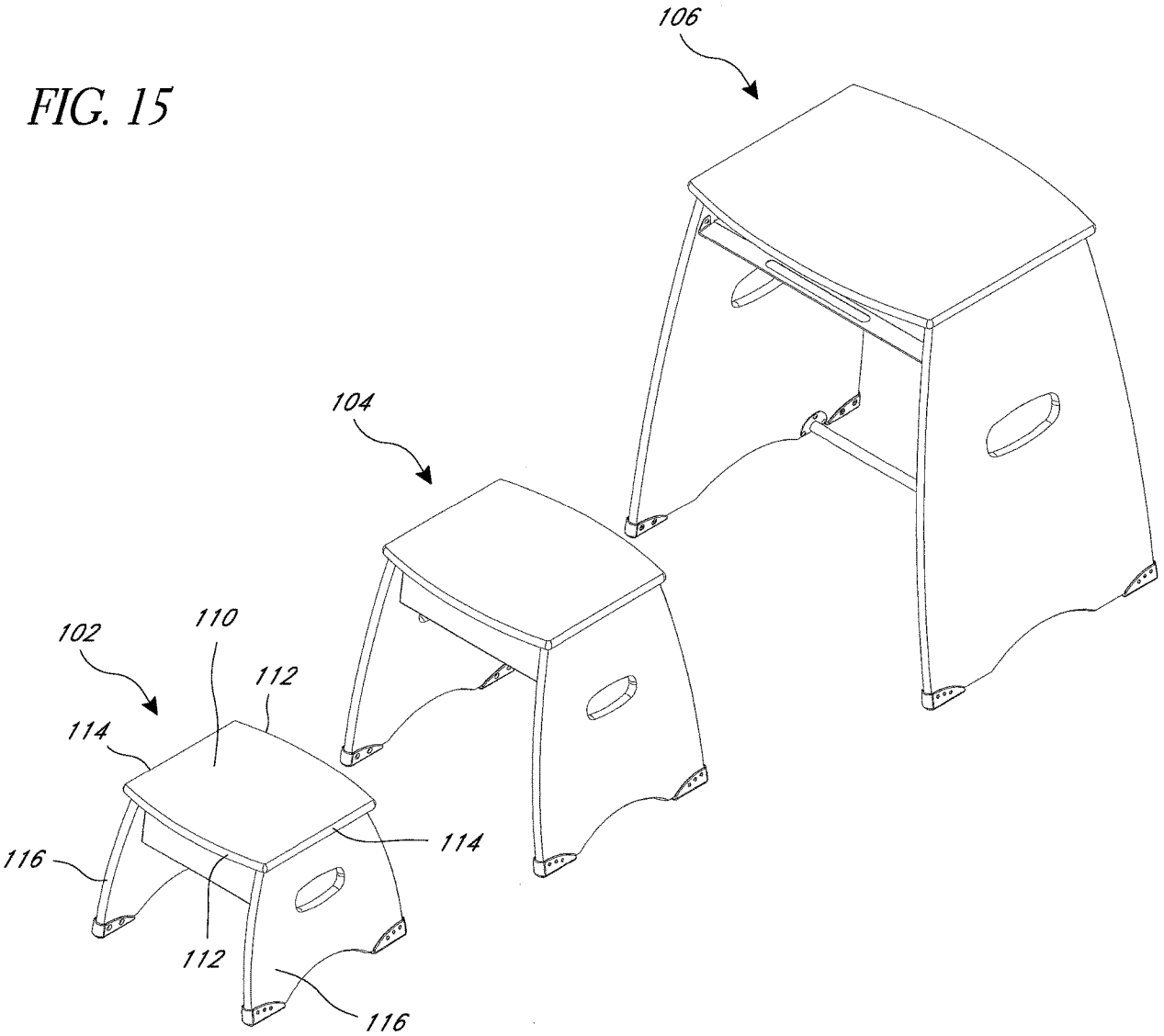
FIG. 15 is a perspective view of three unnested components.

With reference to FIG. 15, the components 102, 104, 106 can be stylistically consistent. In other words, the components 102, 104, 106 can mimic each other albeit in different sizes. The basic structure will be described with reference to the small component 102. Each of the components has a top 110. The top 110 can be formed of any suitable material. In the illustrated configuration, the top 110 can be formed of wood. More particularly, the top 110 can be formed of a laminate material. In some configurations, the laminate material can be a plywood material. The use of plywood or other laminate as the top 110 facilitates matching to various decors. In some configurations, the top 110 can include logos or other designs as desired by the customer. In some configurations, the top 110 can be formed of a water resistant material or the like such that the top 110 can resist warping or disfigurement caused by spills or the like. In some configurations, the top 110 can be formed of a non-skid material, such as rubber. In some configurations, the non-skid material can be applied or provided to the top 110. In some configurations, the top 110 can be provided with a cushion (not shown). The material of the cushion can be polypropylene or the like.

The top 110 can have any suitable configuration. In the illustrated configuration, the top is generally rectangular with two opposing rounded sides 112 and two opposing straight sides 114. The straight sides 114 help increase the size of the top 110 while still allowing for the docking of the components 102, 104, 106 as described above. The curved sides 112 provide an aesthetically pleasing appearance for the product in combination with the straight sides 114. Any other combination of sides or shapes of the top 110 also can be used. In some configurations, the width, which is the distance between opposing straight sides 114, of the top of the smaller component 102 is 20 inches. The width can be between 18 inches and 24 inches. In some configurations, the width of the top of the medium component 102 is 17 inches. The width can be between 12 inches and 72 inches. In some configurations, the width of the top of the smaller component 102 is 14 inches. The width can be between 8 inches and 72 inches.

Below the top 110, two opposing legs 116 extend downwardly. The legs can be formed of any suitable material. In some configurations, the legs 116 can be formed of a laminate material. The laminate material can be a plywood material. As with the top 110, the use of plywood or a laminate material for the legs 116 facilitates matching to various decors. In some configurations, the legs 116 can be formed of a water-resistant material.

Figure 16:
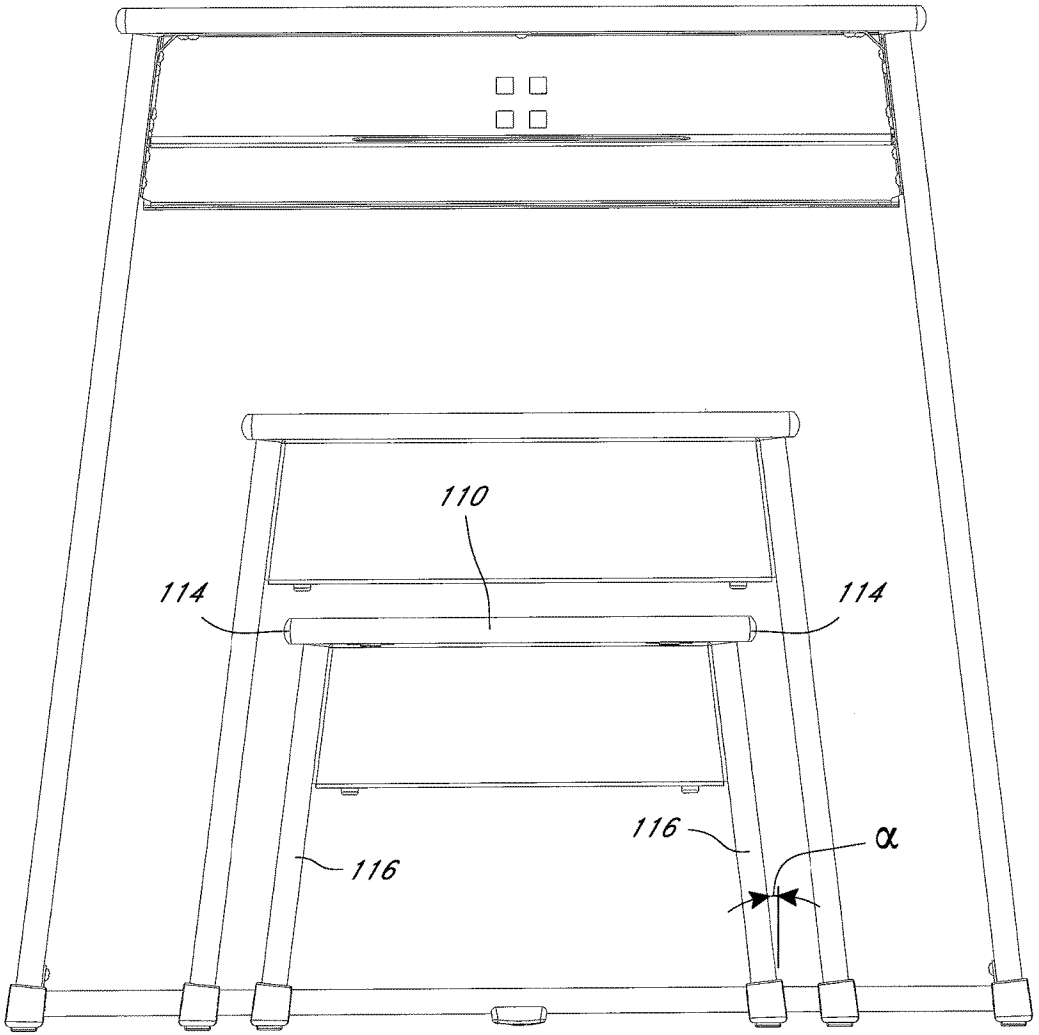
FIG. 16 is a front view of the three components of FIG. 15.

As shown in FIG. 16, the upper portions of the opposing legs 116 are inset relative to the sides 114 of the top 110. The legs 116 preferably are inclined relative to vertical. In the illustrated configuration, the legs 116 are inclined by an angle α. Inclining the legs provides an aesthetically pleasing appearance for the product. The angle α can be any suitable angle keeping in mind that the legs are load bearing. In some configurations, the angle α can be between 4 degrees and 15 degrees. In some configurations, the angle α can be between 5 degrees and 9 degrees. In one configuration, the angle α is 7 degrees. In some configurations, the legs of each of the components 102, 104, 106 are inclined by the same angle α such that the corresponding legs of each of the components 102, 104, 106 extend parallel with each other.

Figure 17:
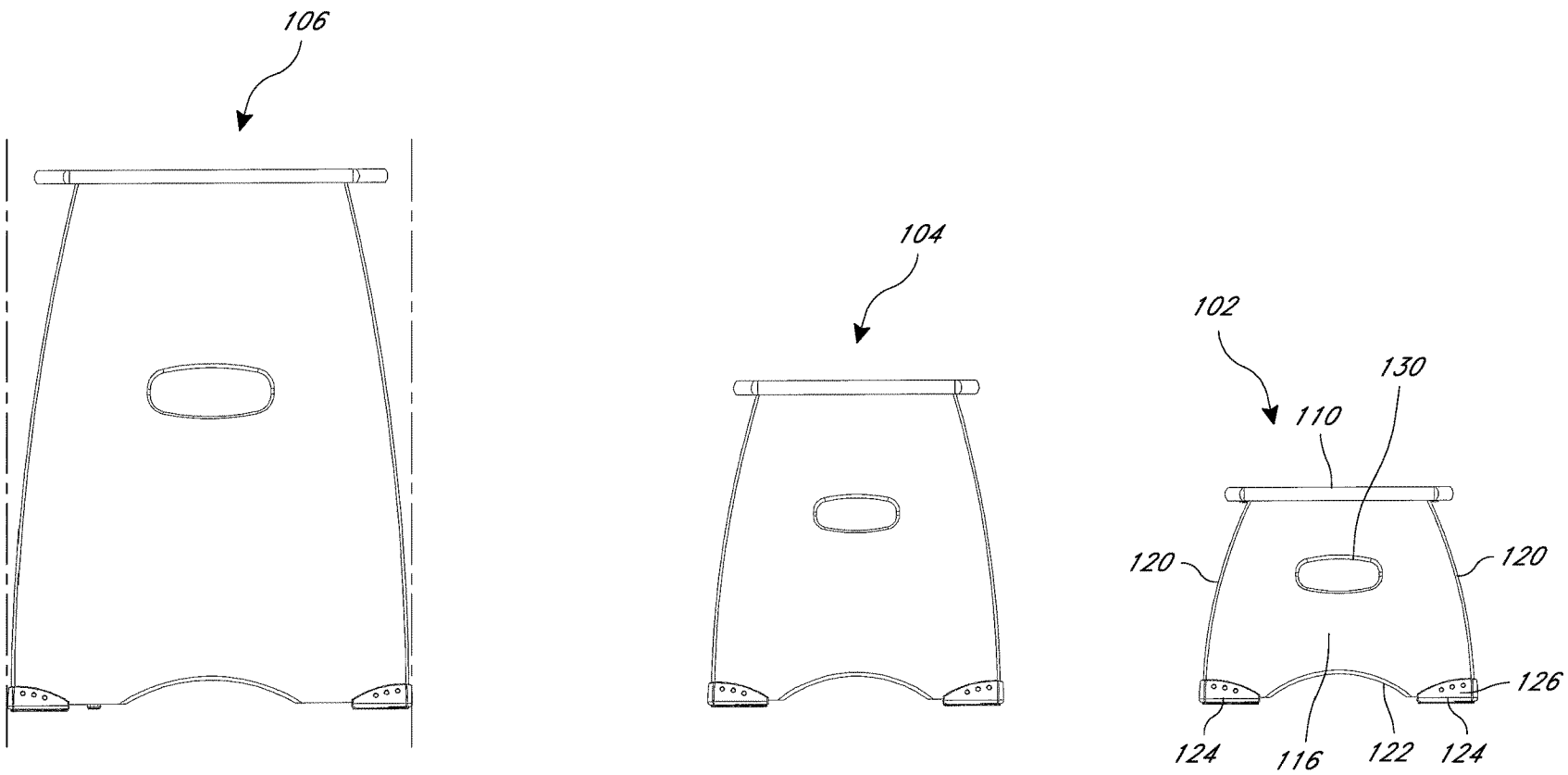
FIG. 17 is a left side view of the three components of FIG. 15.
Figure 18:
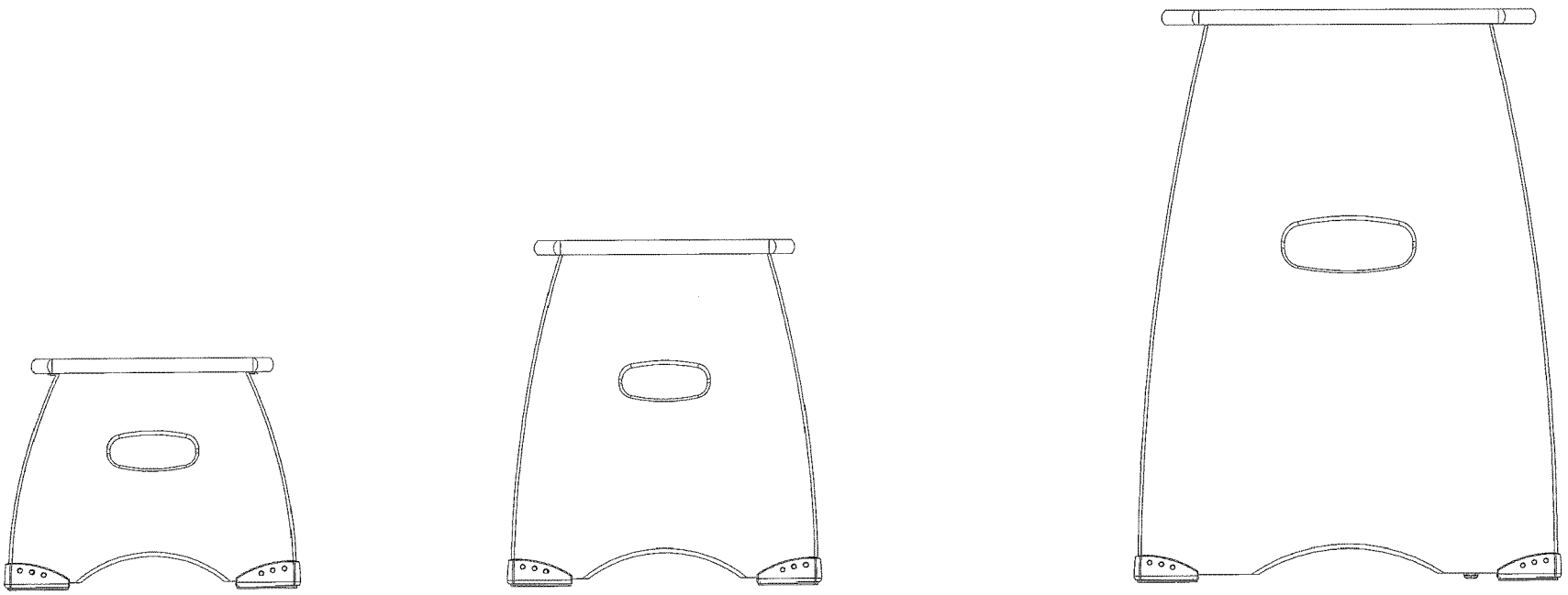
FIG. 18 is a right side view of the three components of FIG. 15.
Figure 19:
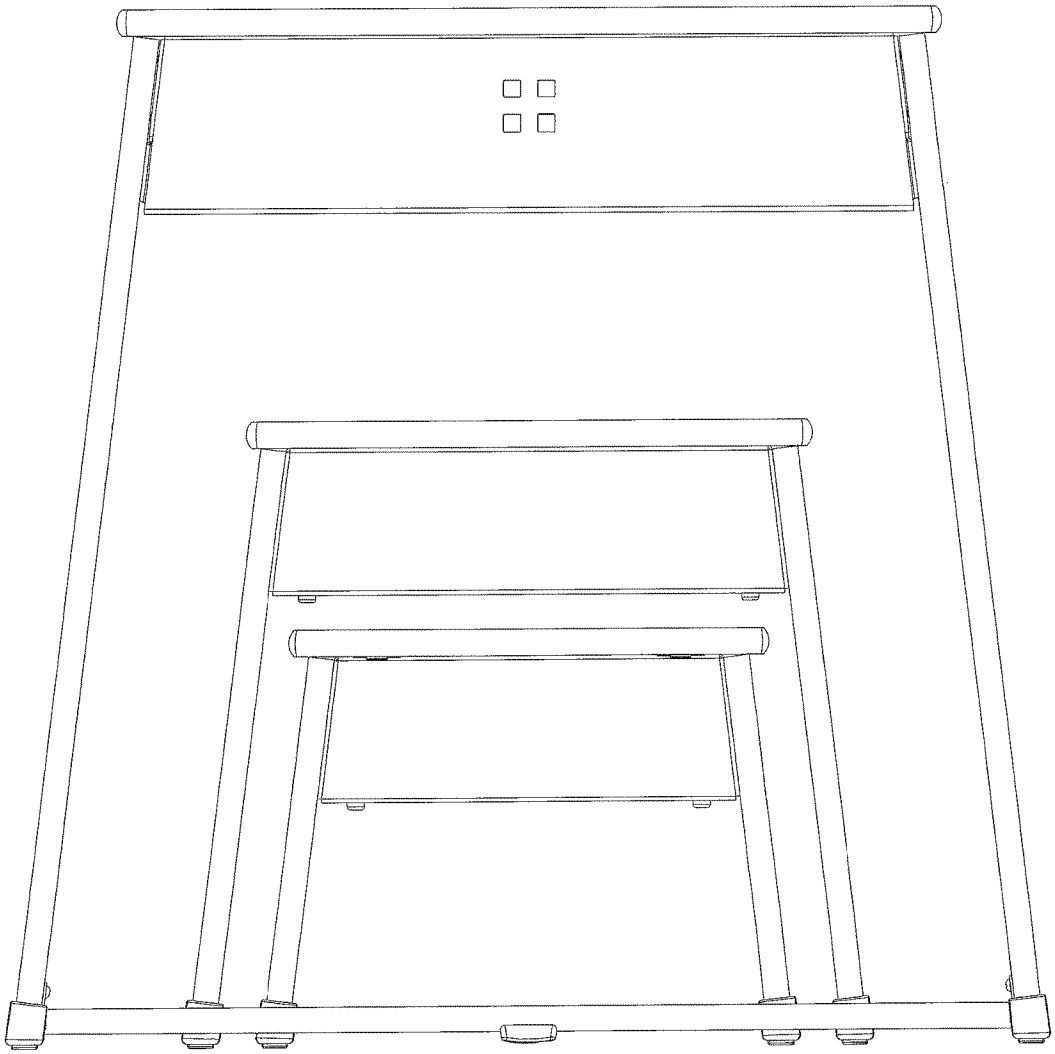
FIG. 19 is a rear view of the three components of FIG. 15.
Figure 20:
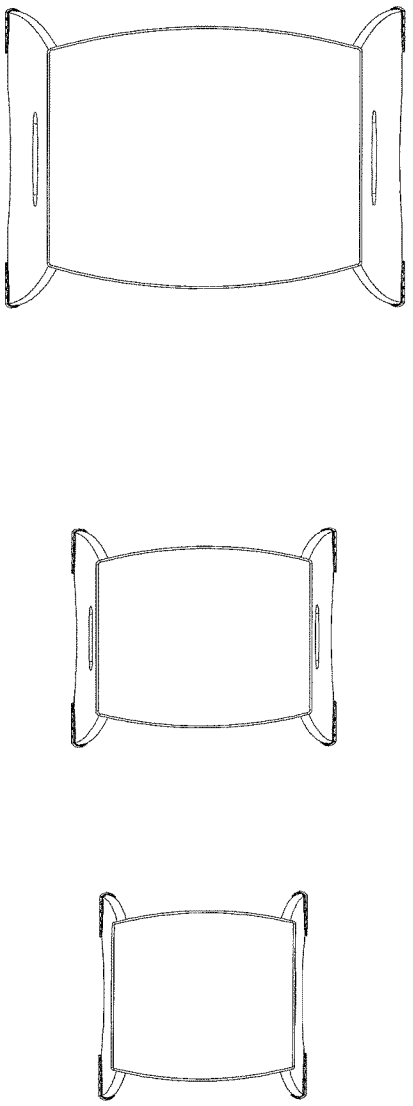
FIG. 20 is a top view of the three components of FIG. 15.
Figure 21:
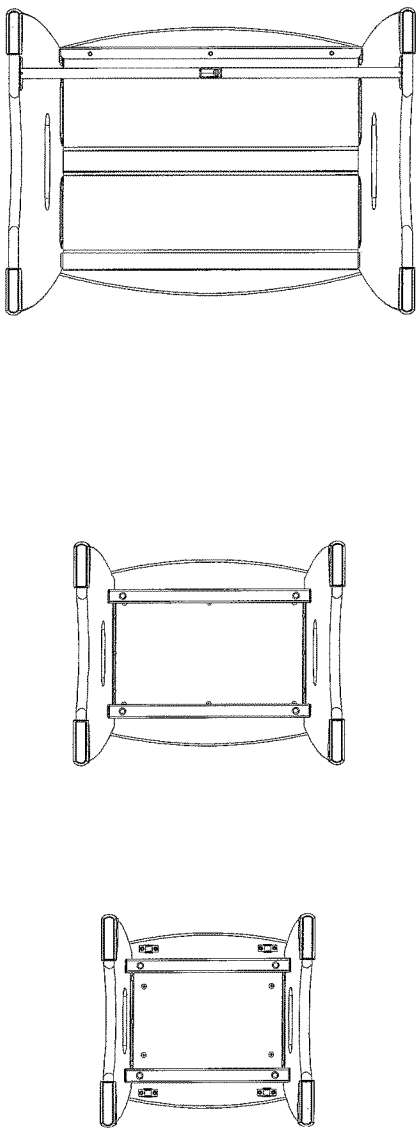
FIG. 21 is a bottom view of the three components of FIG. 15.
Figure 22:
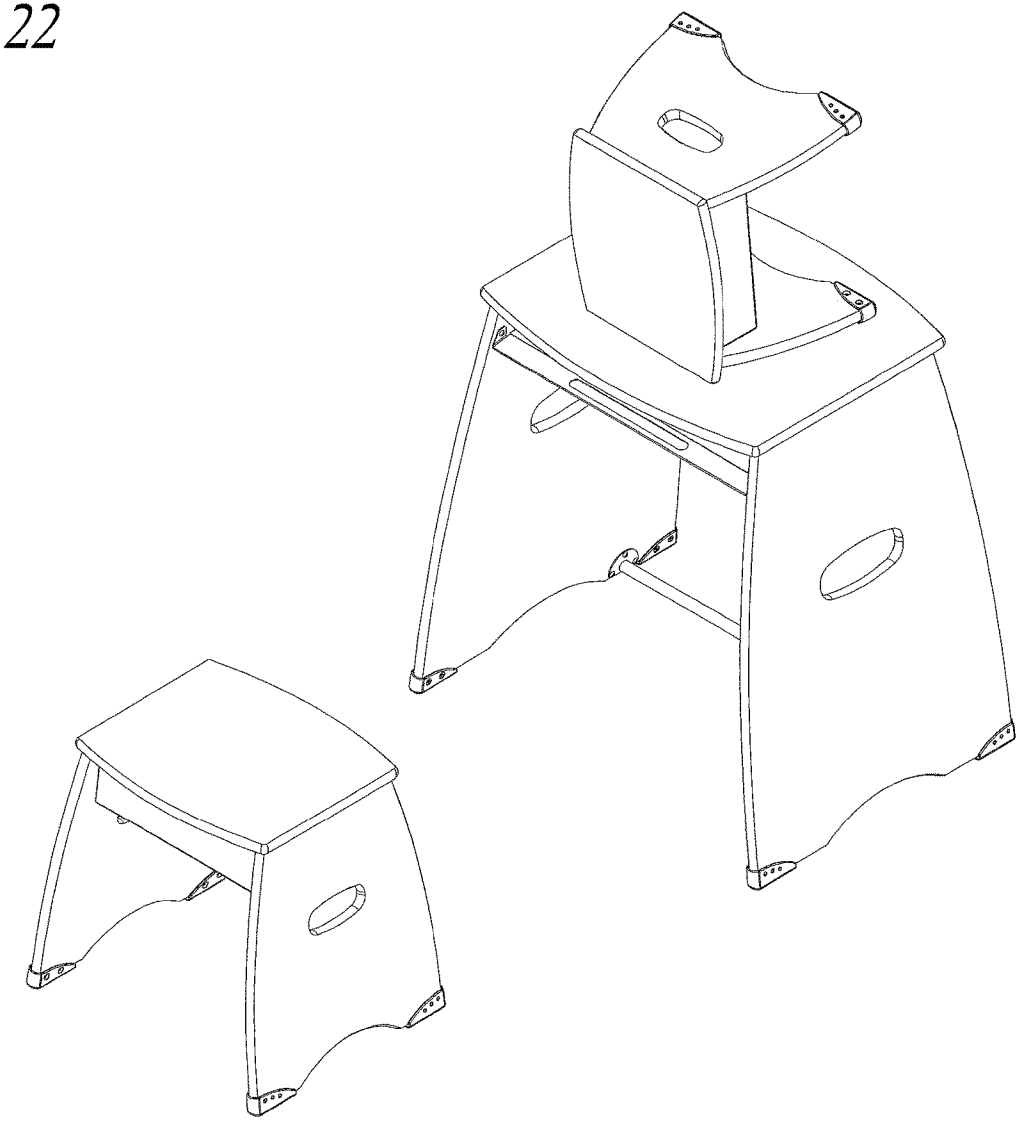
FIG. 22 is a perspective view of three components with the smallest component stacked on top of the largest component in a lectern formation.
Figure 23:
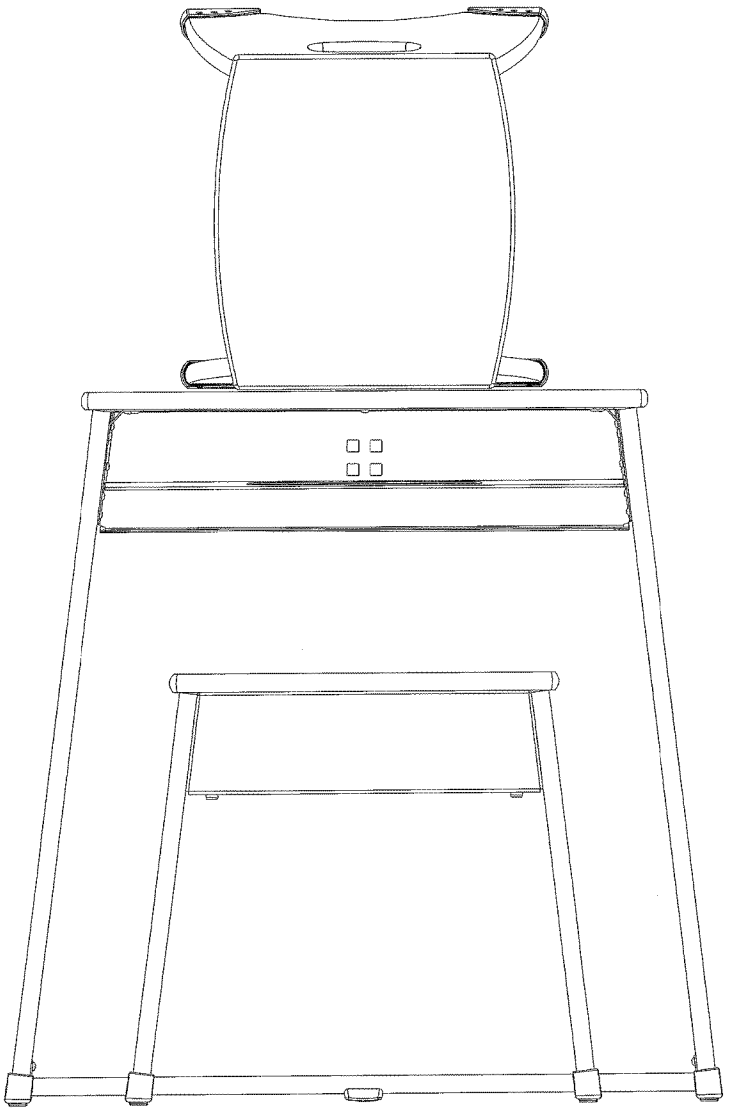
FIG. 23 is a front view of the three components of FIG. 22.
Figure 24:
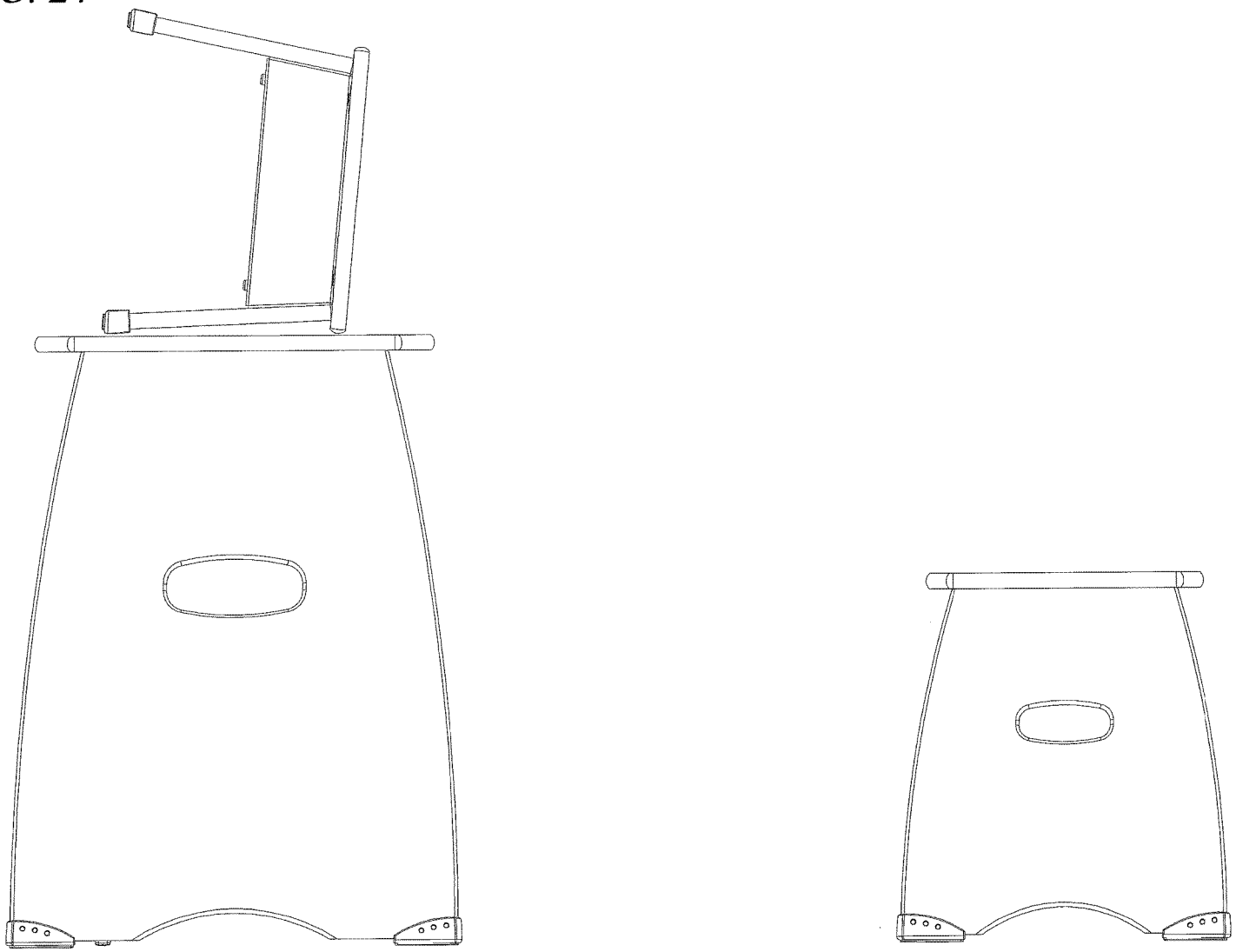
FIG. 24 is a left side view of the three components of FIG. 22.
Figure 25:
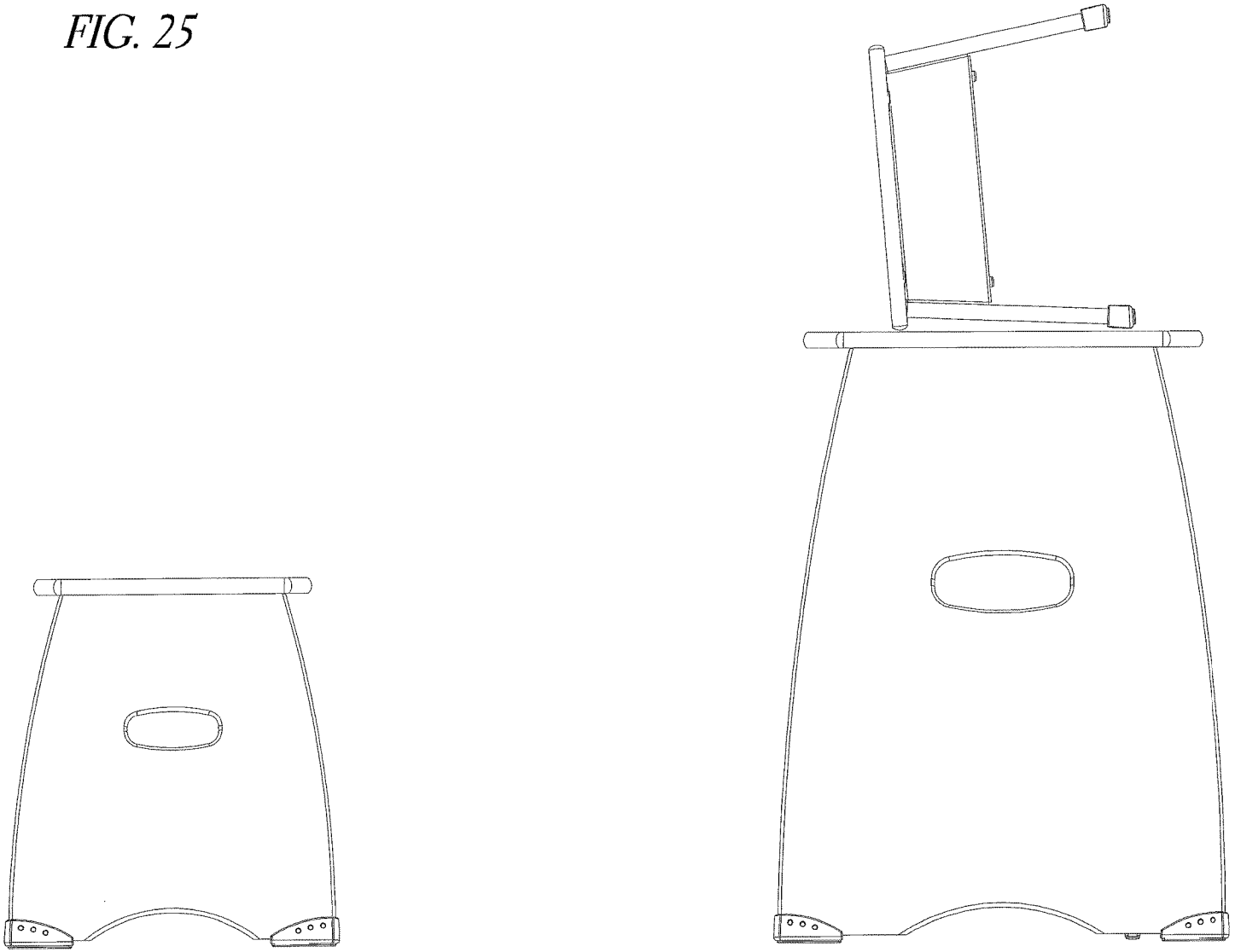
FIG. 25 is a right side view of the three components of FIG. 22.
Figure 26:
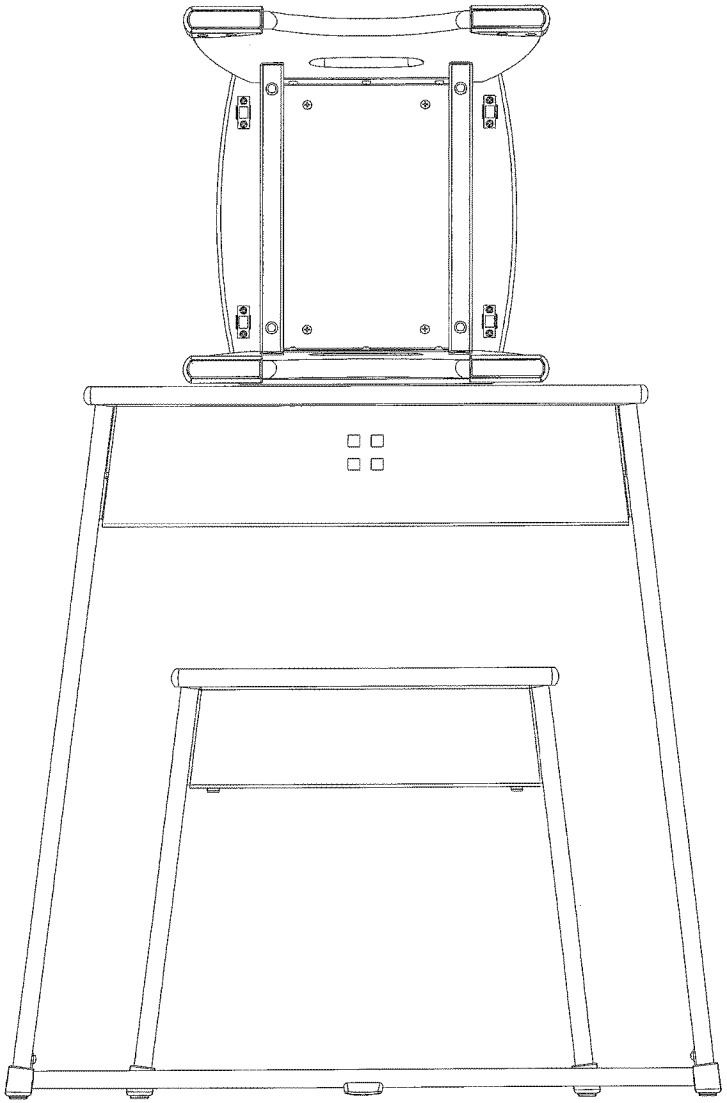
FIG. 26 is a rear view of the three components of FIG. 22.
Figure 27:
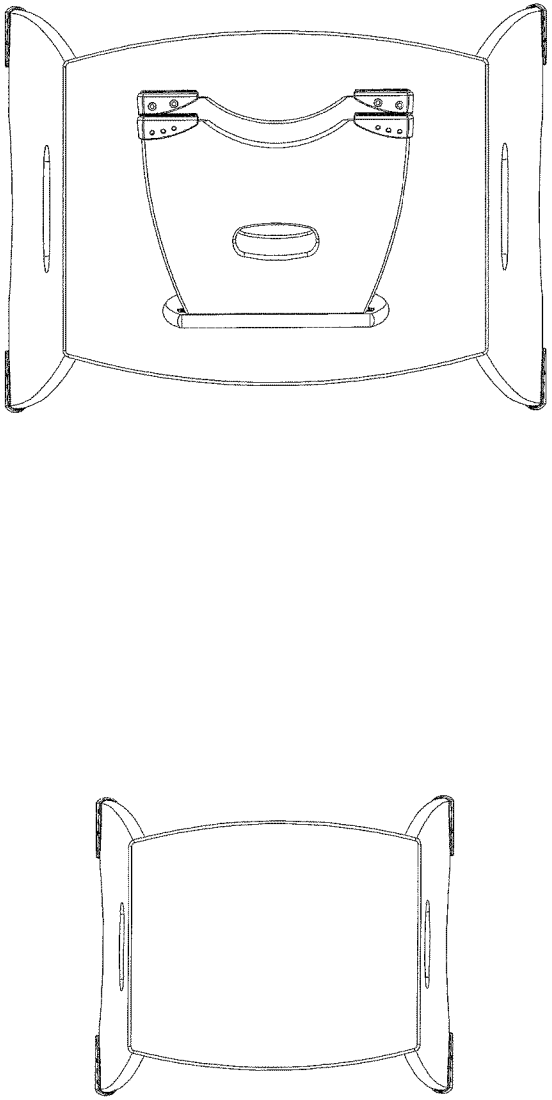
FIG. 27 is a top view of the three components of FIG. 22.
Figure 28:
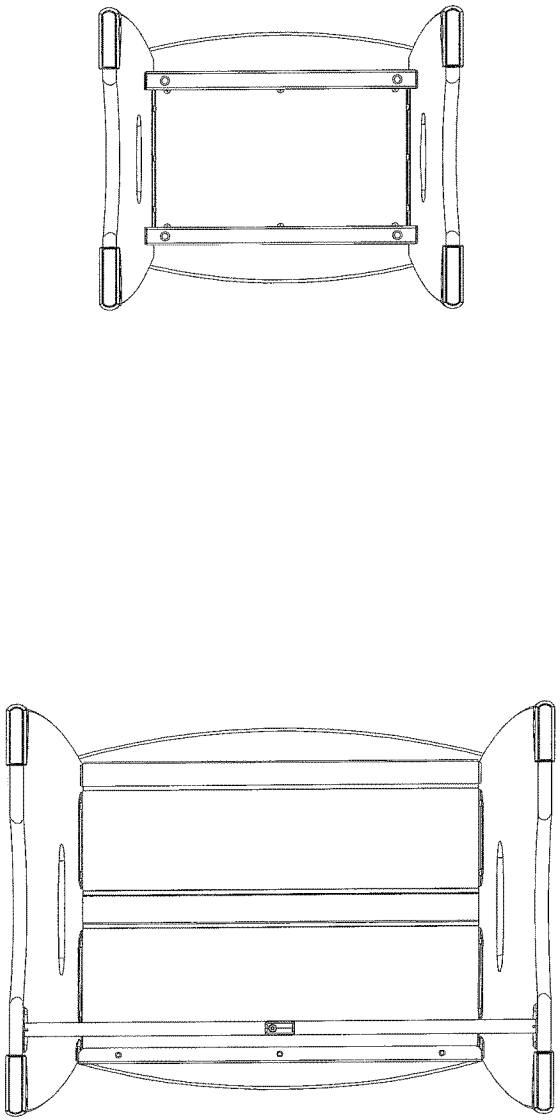
FIG. 28 is a bottom view of the three components of FIG. 22.

With reference now to FIG. 17, the legs 116 have two arcuate or curved sides 120. The curved sides provide an aesthetically pleasing appearance. The sides 120 can be configured to provide a wider width at the bottom of the legs 116 when compared to a width of the legs 116 at the top. Having the legs 116 present a wider base when compared with the top provides an improved stability to the component 102. In some configurations, the base of the legs 116 is wider than the widest width of the top 110 in the same direction as shown by the datum lines in FIG. 17. In some configurations, the two widths differ from each other by between 0 inches and 12 inches. In some configurations, the two widths differ from each other by 4 inches.

The lower portions of the legs 116 include a recess 122 that define feet 124. In the illustrated configuration, the recess 122 is arcuate. The arcuate shape of the recess 122 provides a complementary shape to the arcuate sides 120. Together, these shapes operate to provide a pleasing ornamental appearance. The lower ends of the feet 124 can be mitered to allow the feet to contact a support surface in a flush manner. The mitering of the support surface contacting portions of the feet can increase the contact area between the feet and the surface supporting the component. In addition, due to the inclining of the legs and the mitering of the feet, the surface area in contact with the support surface is increased relative to vertical legs and square bottoms for the feet. In some configurations, the lower ends of the legs can have a convex shape to allow the associated component to rock back-and-forth. For example, the medium size component, which can be configured as a chair, can be provided with rockers defined by the convex shape. In some configurations, the lower ends of the feet 124 or legs can be provided with casters (not shown). For example, the larger size component, which can be configured as a desk, can support the medium and small components above the surface of ground and the casters can allow the combination of the large, medium, and small components to be easily moved about a room or facility.

With reference still to FIG. 17, the feet 124 can be provided with glides 126. In some configurations, the glides 126 are positioned on the side and/or bottom surfaces of the feet that will contact a supporting surface. The glides 126 can cover any surfaces that are designed to contact the supporting surface in order to reduce the likelihood of scratching or marring the supporting surface. In some configurations, the glides 126 can be a co-molded rubber component. In such configurations, a more rigid material can be used to secure the glides 126 to the legs 116 or feet 124 while a softer compound can be used on the base of the feet 124. The material of the support surface contacting portion can be a thermoplastic elastomer (TPE), a thermoplastic rubber (TPR) or an ethyl vinyl acetate (EVA) material while the body of the glides 126 can be polypropylene or the like. In some configurations, the base 124 can reduce friction with an underlying support surface. In some configurations, the base 124 can increase friction with the underlying support surface. As used above, increase and decrease mean relative to configurations in which the material of the legs 116 and/or feet 124 without glides 126 directly contacts the support surface. In addition, similar to the discussion above, the bottom of the glide can be mitered to increase the contact surface area between the bottoms of the glides 126 and the supporting surface. In some embodiments, the glides can include one or more protrusions that can help to reduce slippage when the smaller component 102 is stacked on its side on the top surface of the large component 106, such as illustrated in FIGS. 22-28.

With reference again to FIG. 17, each of the components 102, 104, 106 includes one or more handles 130. The handles 130 can be positioned on or through one or more of the legs 116. In the illustrated configuration, the handles 130 are defined by holes or apertures that extend through the legs 116. The holes or apertures in the illustrated configuration are elongated in the horizontal direction. The holes or apertures are elliptical or oval in configuration. Other shapes are possible. The handles 130 assist in providing a distinct and pleasing ornamental appearance. The handles 130 preferably extend through the legs 116 in a vertical location that is in the upper half of the corresponding leg 116. Any other suitable handle location or configuration can be used.

Figure 29:
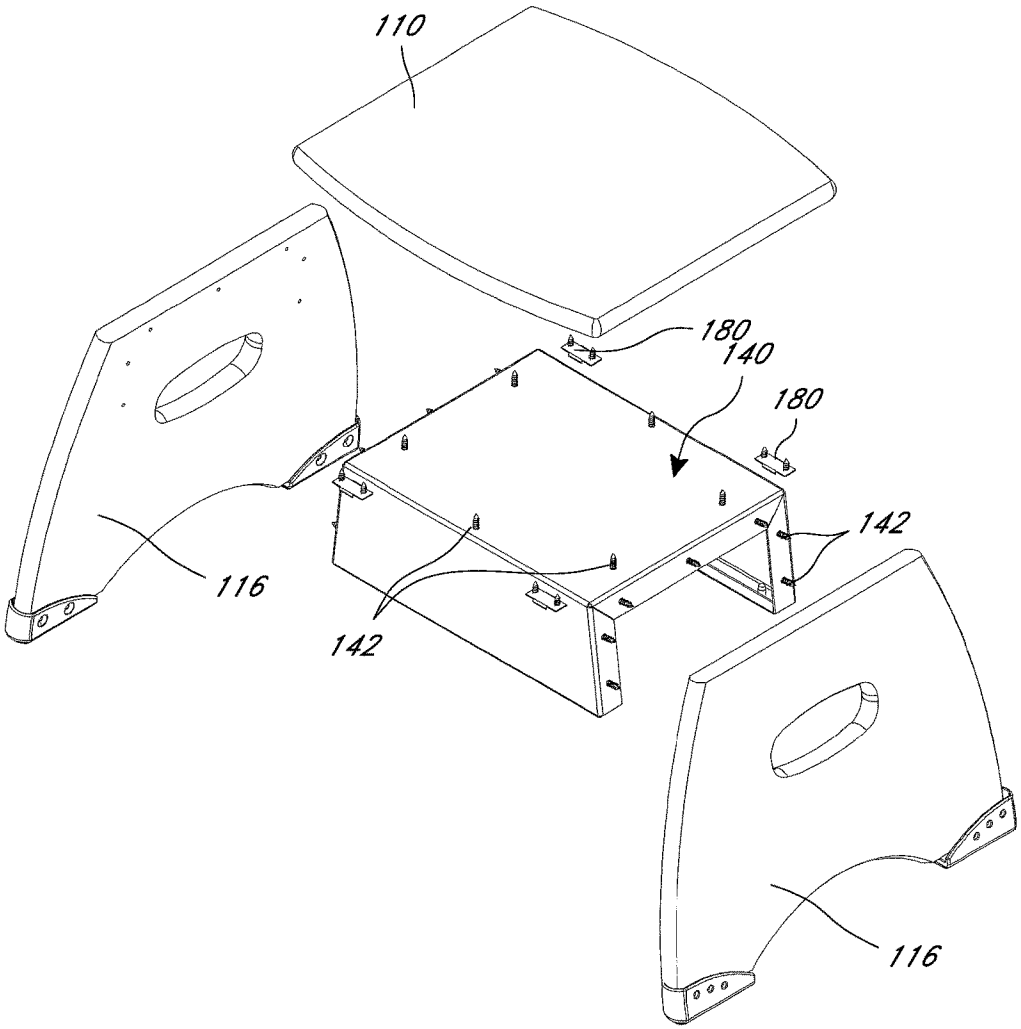
FIG. 29 is an exploded view of the smallest of the three components.

With reference now to FIG. 29, the legs 116 and the top 110 in the illustrated configuration can be connected by a substructure 140. In the illustrated configuration, While the top 110 generally overlays the legs 116, the legs 116 and the top 110 are not directly connected. Rather, in the illustrated configuration, the legs 116 are connected to the substructure 140 and the top 110 is connected to the substructure 140. The legs 116 and/or the top 110 can be connected to the substructure 140 in any suitable manner. In some configurations, mechanical fasteners are used to connect the legs 116 and/or top 110 to the substructure 140. In some such configurations, the mechanical fasteners can be threaded fasteners 142. Any other suitable configuration can be used.

With continued reference to FIG. 29, the substructure 140 can have any suitable configuration. In the illustrated configuration, the substructure 140 can be box-like in appearance. The substructure 140 can be formed of any suitable material. In the illustrated configuration, the substructure 140 can be formed of a metallic material. In some configurations, the metallic material can be steel or aluminum. In some such configurations, the substructure 140 can be laser cut or stamped from the material and then formed in any suitable manner. By forming the substructure of a metallic material, the substructure 140 can be painted to a color that is designed to complement the top 110 and/or the sides 116. The substructure being formed of a metallic material changes the visual appearance while also providing a different material in the overall design. Moreover, the metallic material can increase the load bearing capability of, for example, the smallest component 102 to well in excess of 3000 lbs.

Figure 30:
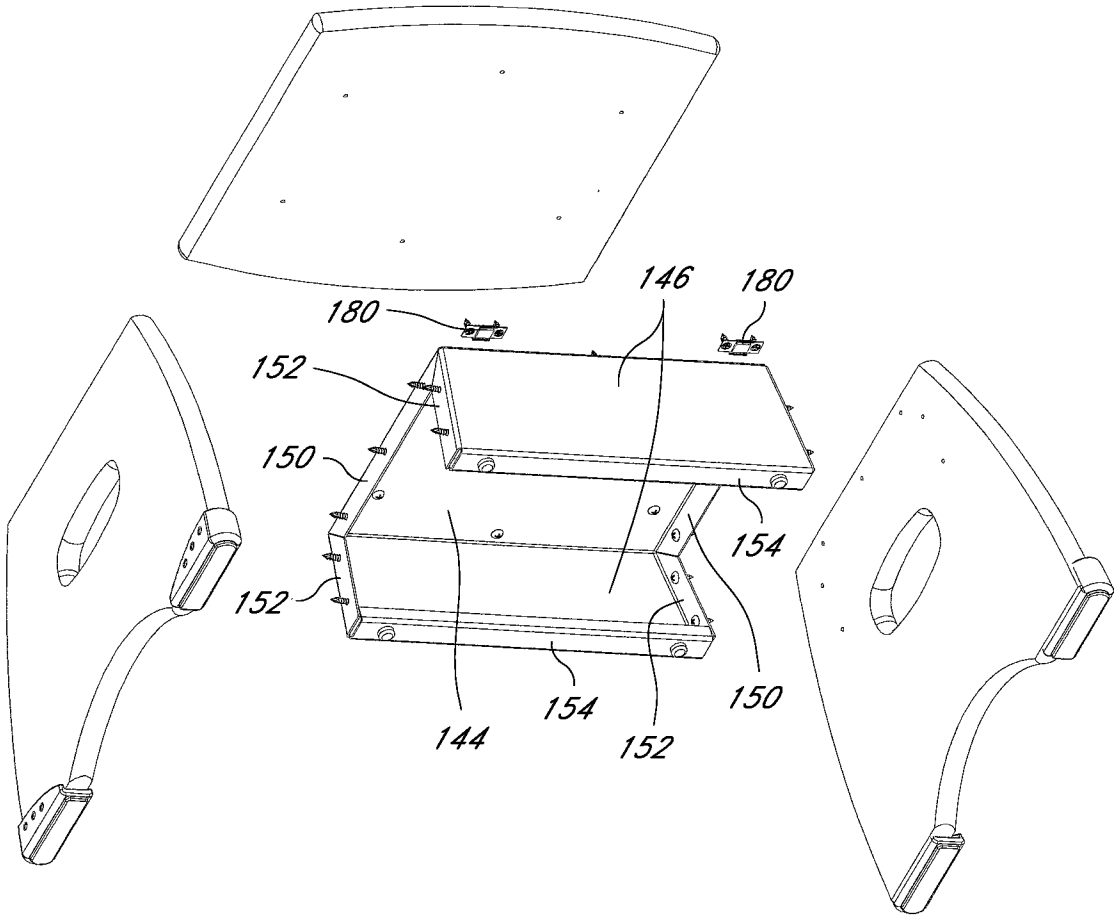
FIG. 30 is another exploded view of the smallest of the three components.

In the configuration illustrated in FIGS. 29 and 30, the substructure 140 comprises an upper wall 144 and at least one side wall 146. The illustrated configuration includes two side walls 146. While the illustrated configuration includes the upper wall 144, it is possible to invert the substructure 140 such that the upper wall 144 defines a lower wall instead of an upper wall. As such, as used herein, the term "horizontal wall" will be used. To maintain consistency, instead of side walls 146, the term "vertical walls" will be used. In this regard, however, perfect verticality is not required for a vertical wall. Rather, the term vertical wall is simply intended to distinguish a wall from a horizontal wall. Accordingly, upper wall and horizontal wall will be used interchangeably and side wall and vertical wall will be used interchangeably.

With reference still to FIGS. 29 and 30, the substructure 140 also includes one or more flanges. In the illustrated configuration, each end of the substructure 140 includes at least one flange 150 depending from the horizontal wall 144. More than one flange can be used, if desired. Each end of each vertical wall 146 also includes at least one flange 152. The at least one flange 150 of the horizontal wall 144 and the at least one flange 152 of the vertical wall 146 can be connected together but need not be connected together. In some configurations, the flanges 150, 152 can be welded together. In some configurations, the flanges 150, 152 are not welded together. In some configurations, the flanges 150, 152 are spaced apart from each other. In some configurations, the vertical walls 146 can also have one or more width-wise extending flange 154. As with the flange 150, 152, the flange 154 can be connected to any of the adjoining flanges 152. In some configurations, the flanges 152, 154 are welded together. In some configurations, the flanges 152, 154 are not welded together. In some configurations, the flanges 150, 152, 154 are spaced apart. Together, the walls 144, 146 and the flanges 150, 152, 154 provide strength and the flanges 150, 152 provide locations to connect the substructure 140 to the legs 116 and/or the top 110. In the illustrated configuration, the threaded fasteners 142 extend through holes in the flanges 150, 152 and into the legs 116 and/or top. Other configurations also are possible.

Each of the substructures 140, as described directly above, provides strength to the component. As discussed above, the components 102, 104, 106 vary from each other with respect to sizing. The substructures also can vary with respect to sizing. In some configurations, the proportionality of the substructure 140 relative to the component remains consistent. In some configurations, a ratio of the top to bottom dimension of the substructure relative to a top to bottom dimension of the component is between 1:10 and 1:1. In some configurations, the ratio is 4:12.

Figure 31:
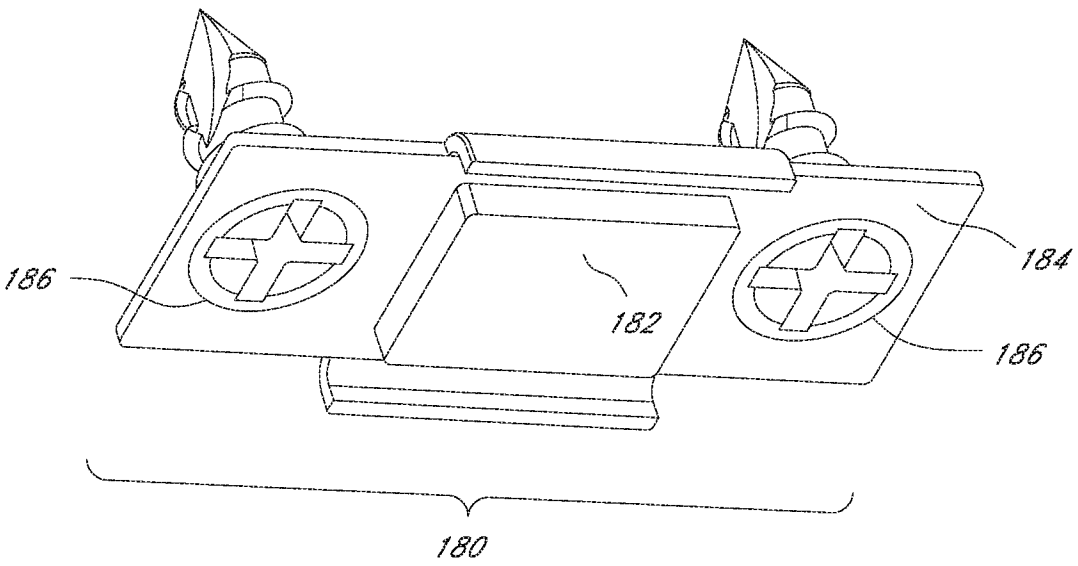
FIG. 31 is an enlarged perspective view of a magnetic component used with the smallest of the three components.

With reference to FIG. 31, a magnetic component 180 is illustrated. In the illustrated configuration, the magnetic component includes a magnet 182, a mounting plate 184, and mechanical fasteners 186. In some configurations, the magnet 182 and/or the mounting plate 184 are rectangular. Other shapes are possible. In some configurations, the mechanical fasteners 186 are threaded fasteners. The threaded fasteners can be used to secure the magnetic component to a portion of one or more of the three components. In some configurations, the magnetic component is secured to an obscured portion of the corresponding component. In the illustrated configuration, the threaded fasteners are used to secure the mounting plate and the corresponding magnet to the bottom surface of the top 110. In some configurations, the magnetic component can be used for the storage of one or more magnetic items (not shown) by securing the magnetic item to the magnet 182.

Figure 32:
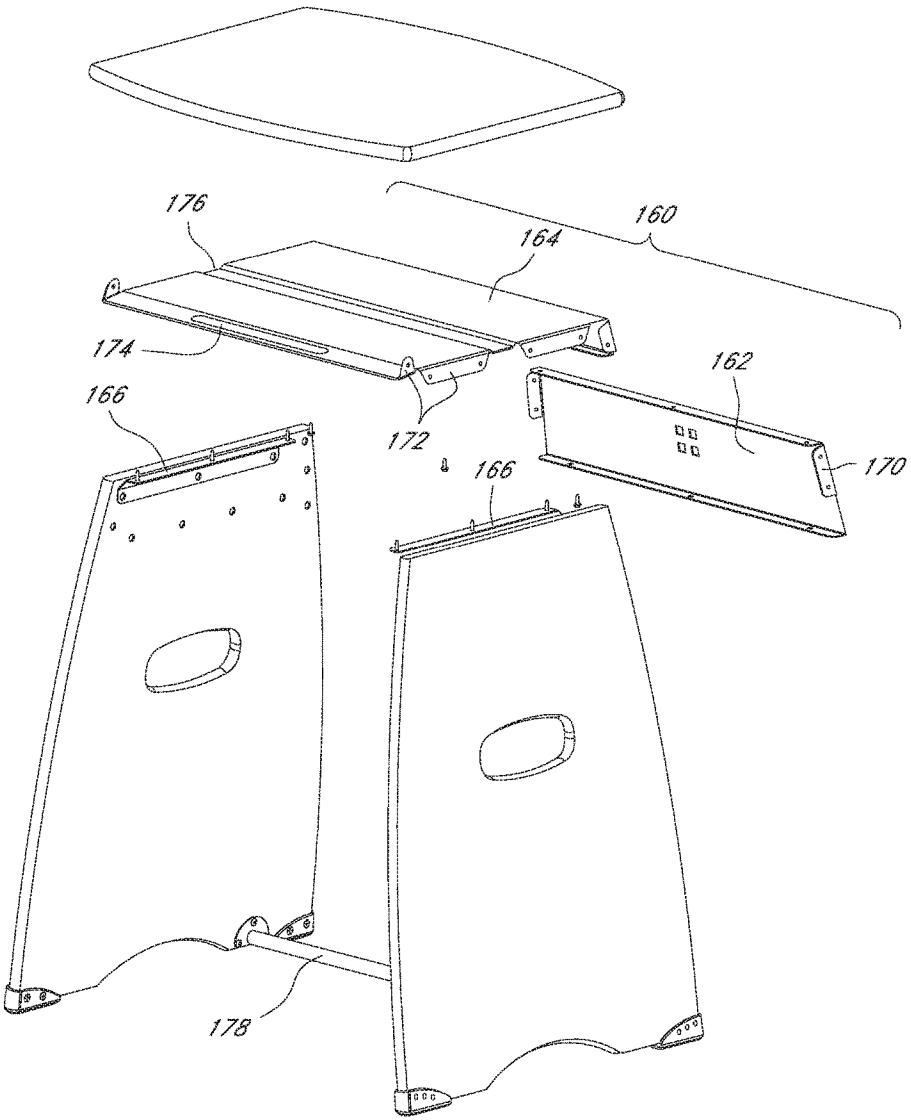
FIG. 32 is an exploded view of the largest of the three components.

With reference to FIG. 32, a two-piece substructure 160 is illustrated. As with the one-piece substructure, the two-piece substructure 160 ties together the legs 116 and the top 110 of the associated component. In some configurations, the two-piece structure 160 is used with the larger component 106. In other configurations, the two-piece structure 160 is used with two or more of the components 102, 104, 106.

In the illustrated configuration, the two-piece substructure 160 comprises a first predominantly vertical wall 162 and a second predominantly horizontal wall 164. In the illustrated configuration, the two-piece substructure also cooperates with two rails 166. The rails 166 can be secured to the sides 116. Additionally, the rails 166 and the vertical wall 162 can be secured to the top 110. The vertical wall 162 and the horizontal wall 162, 164 also can be secured to the sides 116. Finally, the vertical wall 162 and the horizontal wall 164 can be nested together and secured together. Flanges 170 can be provided to the vertical wall 162 and flanges 172 can be provided to the horizontal wall 164. As illustrated, the flanges accommodate openings for threaded fasteners that secure the components 110, 116, 162, 164, 166 together. The vertical wall 162 can include apertures to allow for the passage of wires and the like.

The two-piece substructure 160 can have any suitable configuration. In some configuration, a writing instrument retention channel 174 can be provided. In some configurations, a stiffening channel 176 can be provided. A door (not shown), a drawer (not shown), a keyboard tray (not shown), a storage box (not shown), or the like also can be used in conjunction with either or both of the one-piece substructure 140 and the two-piece substructure 160.

While the substructure 140, 160 can be used to interconnect the legs and top of the components, in some configurations, further reinforcement may be desired. For example, with respect to the larger component 106, the lower portions of the legs are distant from the substructure 160. In some such configurations, a crossmember 178 can be provided to strength the component 106. The crossmember spans between the legs. Each end of the crossmember can be secured to one of the opposing legs of the component. Any suitable configuration can be used to secure the crossmember 178 to the legs 116. In the illustrated configuration, the ends of the crossmember 178 are secured to the legs 116 with a flange. The crossmember 178 can include a foot, a support, or other structure. In the illustrated configuration, the foot, support or other structure can be positioned in a medial portion of the length of the crossmember 178.

Figure 33:
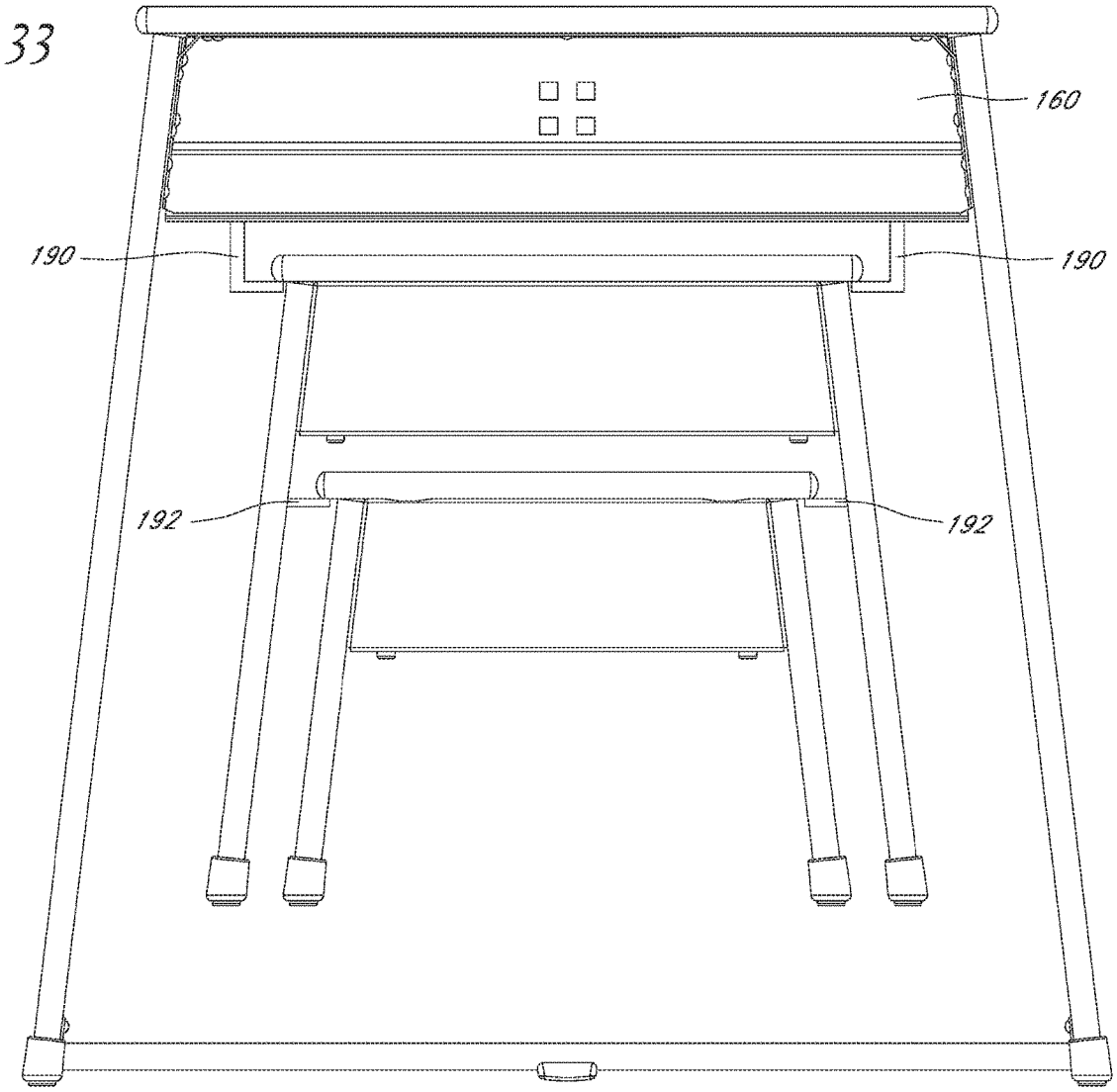
FIG. 33 is a front view of the three components nested together with the two smaller components suspended from the larger component.

With reference to FIG. 33, retention members are illustrated. In some configurations, the substructure 160 can include retention members 190. The retention members 190 can extend from the substructure 160 and provide for mounting the medium component 104 in a nested configuration. In some configurations, the medium component 104 can include retention members 192. The retention members 192 can extend from the legs 116 and provide for mounting the small component 102 in a nested configuration. The retention members 190, 192 have horizontal portions configured so that the top 110 of the corresponding nested component can be suspended above the ground. The nested configuration provides for the medium component 104 and the small component 102 to be incorporated within the large component 106 as a single integrated structure. This allows the large component 106 to be move around without requiring each of the smaller components 102, 104 to be moved individually. In the nested configuration the small component 102 and medium component 104 are suspended off the ground and positioned within the footprint of the large component 106.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements, and/or states are in any way required for one or more embodiments or that one or more embodiments necessarily include these features, elements, and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

While the above detailed description may have shown, described, and pointed out novel features as applied to various embodiments, it may be understood that various omissions, substitutions, and/or changes in the form and details of any particular embodiment may be made without departing from the spirit of the disclosure. As may be recognized, certain embodiments may be embodied within a form that does not provide all of the features and benefits set forth herein, as some features may be used or practiced separately from others.

Additionally, features described in connection with one embodiment can be incorporated into another of the disclosed embodiments, even if not expressly discussed herein, and embodiments having the combination of features still fall within the scope of the disclosure. For example, features described above in connection with one embodiment can be used with a different embodiment described herein and the combination still fall within the scope of the disclosure.

It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above. Accordingly, unless otherwise stated, or unless clearly incompatible, each embodiment of this disclosure may comprise, additional to its essential features described herein, one or more features as described herein from each other embodiment disclosed herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added.

Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Reference to any prior art in this description is not, and should not be taken as, an acknowledgement or any form of suggestion that that prior art forms part of the common general knowledge in the field of endeavor in any country in the world.

The invention may also be said broadly to consist in the parts, elements and features referred to or indicated in the description of the application, individually or collectively, in any or all combinations of two or more of said parts, elements or features.

Where, in the foregoing description, reference has been made to integers or components having known equivalents thereof, those integers are herein incorporated as if individually set forth. In addition, where the term "substantially" or any of its variants have been used as a word of approximation adjacent to a numerical value or range, it is intended to provide sufficient flexibility in the adjacent numerical value or range that encompasses standard manufacturing tolerances and/or rounding to the next significant figure, whichever is greater.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects, and advantages are necessarily required to practice the present invention. Accordingly, the scope of the present invention is intended to be defined only by the claims.

What is claimed is:

1. A reconfigurable furniture system comprising:

a first component comprising a first top panel, a first leg, a second leg, the first leg and the second leg opposing each other, the first top panel being joined to the first leg and the second leg, upper portions of each of the first leg and the second leg being inset relative to an outer periphery of the first top panel, each of the first leg and the second leg having two arcuate sides, lower portions of each of the first leg and the second leg having a concave recess that defines a first foot and a second foot; and a second component comprising a second top panel, a third leg, a fourth leg, and a handle, the third leg and the fourth leg opposing each other, the second top panel being joined to the third leg and the fourth leg, upper portions of each of the third leg and the fourth leg being inset relative to an outer periphery of the second top panel, each of the third leg and the fourth leg having two arcuate sides, lower portions of each of the third leg and the fourth leg having a concave recess that defines a third foot and a fourth foot, the second component being sized to fit entirely within an area defined by a footprint of the first component when the second component is positioned under the first top panel of the first component, wherein a footprint of the second component is smaller than the footprint of the first component, wherein the first component comprises at least one retention member configured to allow the second component to be suspended from the first component.

2. The reconfigurable furniture system of claim 1, wherein the second component being sized to fit entirely within an area defined by the first top panel when the second component is stacked on top of the first component.

3. The reconfigurable furniture system of claim 1 further comprising a third component comprising a third top panel, a fifth leg, a sixth leg, the fifth leg and the sixth leg opposing each other, the third top panel being joined to the fifth leg and the sixth leg, upper portions of the fifth leg and the sixth leg being inset relative to an outer periphery of the third top panel, the third component being sized to fit entirely within an area defined by the footprint of the second component when the third component is positioned under the second top panel of the second component.

4. The reconfigurable furniture system of claim 3, wherein the second component further comprises at least one retention member configured to allow the third component to be suspended from the second component.

5. The reconfigurable furniture system of claim 3, wherein the first component is a desk, the second component is a chair, and the third component is a stool.

6. The reconfigurable furniture system of claim 1, wherein the second component further comprises glides positioned on the third foot and the fourth foot of each leg.

7. The reconfigurable furniture system of claim 1, wherein the first component further comprises at least one handle disposed on at least one of the first leg or second leg.

* * * * *